US008490753B2

(12) United States Patent
Yamamoto

(10) Patent No.: US 8,490,753 B2
(45) Date of Patent: Jul. 23, 2013

(54) ELEVATOR CONTROL APPARATUS WITH SPEED CONTROL TO ALLEVIATE PASSENGER EAR BLOCK DISCOMFORT

(75) Inventor: Keigo Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 345 days.

(21) Appl. No.: 12/997,782

(22) PCT Filed: Jun. 13, 2008

(86) PCT No.: PCT/JP2008/060882

§ 371 (c)(1),
(2), (4) Date: Dec. 13, 2010

(87) PCT Pub. No.: WO2009/150746

PCT Pub. Date: Dec. 17, 2009

(65) Prior Publication Data

US 2011/0108368 A1 May 12, 2011

(51) Int. Cl.
*B66B 1/28* (2006.01)

(52) U.S. Cl.
USPC ..... 187/295; 187/391

(58) Field of Classification Search
CPC ..... B66B 11/00; B66B 1/06; B66B 1/24
USPC ..... 187/289, 293, 391–393, 401, 295
See application file for complete search history.

(56) References Cited

U.S. PATENT DOCUMENTS 5,035,301 A * 7/1991 Skalski ..... 187/295
5,889,238 A * 3/1999 Ernecke et al. ..... 187/291

(Continued)

FOREIGN PATENT DOCUMENTS

JP 52-106552 9/1977
JP 7 112876 5/1995

(Continued)

OTHER PUBLICATIONS

International Search Report issued Mar. 3, 2009 in PCT/JP08/60882 filed Jun. 13, 2008.

(Continued)

*Primary Examiner* — Anthony Salata
(74) *Attorney, Agent, or Firm* — Oblon, Spivak, McClelland, Maier & Neustadt, L.L.P.

(57) ABSTRACT

To alleviate the ear block discomfort of passengers without causing any undue reduction in the operational efficiency of an elevator. A travel distance calculating section 13 calculates a travel distance of a car room 1 based on destination floor information 12*a* and a car position command signal 3*a*, and output travel distance information 13*a* to a speed pattern generating section 14. The speed pattern generating section 14 compares the travel distance with a predetermined distance, generates a speed pattern 14*a* of a normal operation if the travel distance is short, and generates the speed pattern 14*a* of a partially low speed operation if the travel distance is long. The predetermined distance indicates a difference in height corresponding to a difference in air pressure that causes the Eustachian tube to open against ear block discomfort by a passenger. A speed control section 24 makes the car room 1 move up and down based on the speed pattern 14*a*. This allows the car room 1 to move at low speed after the first opening of the Eustachian tube, and therefore an interval in time when the car room 1 moves of a distance of the difference in height causing another ear block discomfort is made long. The ear block discomfort of passengers may thus be alleviated.

10 Claims, 16 Drawing Sheets

U.S. PATENT DOCUMENTS

| | | | | |
|---|---|---|---|---|
| 7,267,203 | B2 * | 9/2007 | Sekimoto | 187/393 |
| 7,762,875 | B2 * | 7/2010 | Sekimoto | 454/68 |
| 7,946,392 | B2 * | 5/2011 | Rotboll | 187/316 |
| 2004/0222048 | A1 * | 11/2004 | Mizuno et al. | 187/401 |
| 2009/0152053 | A1 * | 6/2009 | Smith et al. | 187/247 |
| 2010/0078267 | A1 * | 4/2010 | Hashimoto | 187/296 |
| 2010/0126809 | A1 * | 5/2010 | Foschini et al. | 187/293 |
| 2012/0222917 | A1 * | 9/2012 | Villa et al. | 187/293 |

FOREIGN PATENT DOCUMENTS

| | | | |
|---|---|---|---|
| JP | 7 112879 | | 5/1995 |
| JP | 10 182039 | | 7/1998 |
| JP | 11 71077 | | 3/1999 |
| JP | 11 79571 | | 3/1999 |
| JP | 2008 133126 | | 6/2008 |
| JP | 2008133126 | A * | 6/2008 |
| JP | 2010269855 | A * | 12/2010 |

OTHER PUBLICATIONS

Funai, Kiyoshi et al., "Analysis of Tympanic Membrane Behavior and Ear Block Discomfort for Super High Speed Elevators", Japan Society of Mechanical Engineers (JSME), pp. 27-30, (Jan. 21, 2004).

Office Action issued on May 16, 2012 in the corresponding Korean Application No. 10-2010-7025313 (with Partial English-language translation).

Office Action issued Dec. 11, 2012 in Japanese Application No. 2010-516697 (w/partial English translation).

Office Action issued Jan. 5, 2013 in Chinese Application No. 200880129785.5 (w/partial English translation).

* cited by examiner

Fig. 13

| | | $L \leqq L_a$ | $L_a < L \leqq L_b$ | $L_b < L$ |
|---|---|---|---|---|
| ASCENDING | SPEED CONTROL | NORMAL | PARTIALLY LOW SPEED | |
| | PRESSURE CONTROL | × | | |
| DESCENDING | SPEED CONTROL | NORMAL | | PARTIALLY LOW SPEED (UNDER PRESSURE CONTROL) |
| | PRESSURE CONTROL | × | ○ | |

ELEVATOR CONTROL APPARATUS WITH SPEED CONTROL TO ALLEVIATE PASSENGER EAR BLOCK DISCOMFORT

TECHNICAL FIELD

The present invention relates to an elevator control apparatus and an elevator apparatus that are designed to alleviate the ear block discomfort of passengers, for example.

BACKGROUND ART

There are have been techniques designed for alleviating the ear block discomfort of passengers in traveling elevator cars, ascending or descending: one is making an elevator move at a low speed (Patent Document 1 and Patent Document 2); and another is controlling air pressure inside an elevator car so that the air pressure changes at a constant rate (Patent Document 3).

FIG. 19 shows a speed control pattern of an existing elevator.

Referring to FIG. 19, in Patent Document 1 and Patent Document 2, an elevator car moves from a starting floor to a destination floor at a low speed (indicated by a broken line $a_2$), which is slower than a rated speed (indicated by a solid line $a_1$).

In the case of Patent Document 1, the operational speed (a rated speed or a low speed) of an elevator car is selected according to a passenger operation of a floor switch at an elevator lobby.

In the case of Patent Documents 2, the operational speed of an elevator car is automatically switched according to the travel distance of the elevator car from a starting floor to a destination floor.

FIG. 20 shows a pattern of an air pressure control of an existing elevator.

In the case of Patent Document 3, air pressure inside an elevator car is controlled to have a linear change (at a constant rate) as a broken line $c_2$ shows in FIG. 20.

Referring to FIG. 20, a solid line $c_1$ shows a change pattern in air pressure in an elevator car when it is not controlled.

As the solid line $c_1$ indicates, air pressure in an elevator car without control shows a change similar to a letter S on the whole. Specifically, air pressure in an elevator car changes in a curved fashion as the elevator car is accelerated when leaving a starting floor; then the inside air pressure changes in a linear fashion as the elevator car performs a constant speed operation at a rated speed until approaching the vicinity of a destination floor; and the inside air pressure changes in a curved fashion as the elevator car is decelerated when approaching the destination floor.

Patent Document 1: JP 11-79571 A
Patent Document 2: JP 7-112876 A
Patent Document 3: JP 10-182039 A
Non-patent Literature 1: "Analysis of Tympanic Membrane Behavior and Ear Block Discomfort for Super High Speed Elevators" by Kiyoshi FUNAI, Yoshikatsu HAYASHI, Takayuki KOIZUMI, Nobutaka TSUJIUCHI, and Mitsuharu OKAMOTO; "Elevator, Escalator and Amusement Rides Conference 2004", pp 27-30, Jan. 21, 2004, Japan Society of Mechanical Engineers (JSME)

DISCLOSURE OF THE INVENTION

Problems to be Solved by the Invention

If an elevator is operated at low speed, it would take a long travel time to reach a destination floor, for example, which may result in a low efficiency in the operation of an elevator. This problem would have a much greater impact especially on the operation of an elevator traveling over a long distance in a super tall building.

If air pressure in an elevator car is changed at a constant rate, the elevator car needs to be equipped with an air supply fan and an air exhaust fan, or a set of a fan for supplying and exhausting air and a control unit to switch between supplying and exhausting air. This however poses a problem of an increase in the cost of an elevator, and also an increase in the size and weight of an elevator car.

The longer the travel distance, the closer the change pattern in air pressure under control (the broken line $c_2$ shown in FIG. 20) to the change pattern in uncontrolled air pressure (the broken line $c_1$ shown in FIG. 20). More specifically, as the travel distance is increased, the rate of change in uncontrolled air pressure of curved portions during acceleration and deceleration in the change pattern $c_2$ is reduced, and also the rate of change in uncontrolled air pressure of the linearly changing portion during a rated speed operation is increased. Thus, the change pattern $c_2$ in uncontrolled air pressure is approximated to a straight line on the whole.

Therefore, in the case of elevators installed in super tall buildings, it is less effective to change air pressure in an elevator car at a constant rate.

Non-Patent Literature 1 describes that ear block discomfort is strongly related to the amount of change in air pressure rather than the rate of change in air pressure.

It is an object of the present invention to alleviate the ear block discomfort of passengers in an elevator moving up and down, without causing any undue reduction in the operational efficiency of an elevator with a simple configuration, for example.

Means to Solve the Problems

An elevator control apparatus according to the present invention comprises a travel distance calculating section that calculates a travel distance of an elevator car to a destination floor of the elevator car, a speed pattern generating section that compares the travel distance calculated by the travel distance calculating section with a predetermined distance, and generate a speed pattern, and a speed control section that makes the elevator car move to the destination floor based on the speed pattern generated by the speed pattern generating section. The speed pattern is control information indicating a normal operation, which is generated if the travel distance is the same or less than the predetermined distance. The normal operation makes the elevator car accelerate up to a rated speed, move at the rated speed, and decelerate until the elevator car stops. The speed pattern is also control information indicating a partially low speed operation, which is generated if the travel distance is larger than the predetermined distance. The partially low speed operation makes the elevator car accelerate up to the rated speed, move at the rated speed, decelerate to a predetermined low speed, which is lower than the rated speed, move at the predetermined low speed, and decelerate until the elevator car stops.

The elevator control apparatus further comprises an air pressure control setting section configured to compare the travel distance with the predetermined distance when the elevator car is descended to the destination floor, and increase air pressure in the elevator car up to a predetermined air pressure by supplying air into the elevator car if the travel distance is larger than the predetermined distance.

The speed pattern generating section compares the travel distance with a second predetermined distance that is longer than the predetermined distance when the elevator car is descended to the destination floor; generate the speed pattern that is the control information indicating the normal operation if the travel distance is the same or less than the second predetermined distance; and generate the speed pattern that is the control information indicating the partially low speed operation if the travel distance is larger than the second predetermined distance.

The predetermined distance indicates a difference in height corresponding to a difference in air pressure causing the Eustachian tube of a passenger in the elevator car to open.

The speed pattern that is the control information indicating the partially low speed operation specifies that a running speed of the elevator car reach the predetermined low speed when the elevator car decelerates from the rated speed and runs for the predetermined distance.

The speed pattern generating section generates the speed pattern that is the control information indicating the partially low speed operation if the elevator car is descended to the destination floor, and if the travel distance is larger than the predetermined distance.

The predetermined air pressure indicates a difference in air pressure causing the Eustachian tube of a passenger in the elevator car to open.

The air pressure control setting section increases the air pressure in the elevator car up to the predetermined air pressure, and further increases the air pressure in the elevator car by an amount of increased pressure that makes an amount of raised pressure per unit time based on a sum of an amount of raised pressure in the elevator car under air pressure control and an amount of raised pressure in the elevator car according to a descending of the elevator car equal to an amount of raised pressure per unit time of the air pressure in the elevator car when the elevator car is descended at the predetermined low speed.

The speed pattern that is the control information indicating the partially low speed operation specifies that the elevator car reach the predetermined low speed if the air pressure in the elevator car becomes equal to air pressure outside the elevator car.

An elevator apparatus according to the present invention includes the elevator control apparatus described above.

Advantages of the Invention

The present invention may alleviate the ear block discomfort of passengers in an elevator moving up and down, without causing any undue reduction in the operational efficiency of an elevator with a simple configuration, for example.

BEST MODE FOR CARRYING OUT THE INVENTION

Embodiment 1

FIG. 1 shows a configuration of an elevator apparatus 9 according to a first embodiment.

A configuration of the elevator apparatus 9 of the first embodiment will be described below with reference to FIG. 1.

The elevator apparatus 9 includes a car room 1, a hoist 23 to hoist the car room 1, a speed control circuit 24 to control the hoist 23, and an operation control circuit 10 to control the speed control circuit 24.

The operation control circuit 10 (an elevator control apparatus) includes an input circuit 11, an operation control section 12, a travel distance calculating section 13, a speed pattern generating section 14, and an output circuit 15. The operation control circuit 10 is adapted to control the speed control circuit 24 so that the car room 1 is ascended up and descended down based on a specific speed pattern.

The operation control circuit 10 is a type of a computer equipped with a CPU and a storage device (e.g., a semiconductor memory). Each section of the operation control circuit 10 executes a process described below by using the CPU. The process of each section is stored in the storage in advance as a program (e.g., an elevator control program causing a computer to execute an elevator control method described later). The CPU executes programs stored in the storage to function the respective sections. The storage stores data to be inputted/outputted to/from the sections, predetermined values to be used in the processes of the sections, data (e.g. calculated values) generated in the processes of the sections, and the like. Various types of data stored in the storage are used in the respective processes of the sections. For example, contents indicated by a "signal" or "information" described later is an example of data stored in the storage.

The input circuit 11 receives an in-car call command signal 2*a* generated by an operation of a passenger on an in-car control panel 2 installed in the car room 1. The in-car call command signal 2*a* indicates a destination floor of the car room 1 designated by a passenger operating the in-car control panel 2.

The input circuit 11 also receives a floor call command signal 31*a* generated by a passenger operation of a floor control panel 31 installed at an elevator lobby. The floor call command signal 31*a* indicates a starting floor of the car room 1 designated by a passenger operation of the floor control panel 31.

The input circuit 11 also receives a car position command signal 3*a* indicating a current position (a starting floor) of the car room 1 from a car position detection circuit 3. The car position detection circuit 3 is adapted to count the number of rotations of the hoist 23 and calculate a current position of the car room 1, or specify a current position of the car room 1 based on a detection signal of the car room 1 received from a sensor installed in a hoistway, for example.

The input circuit 11 outputs the in-car call command signal 2*a* and the floor call command signal 31*a* to the operation control section 12, and the car position command signal 3*a* to the travel distance calculating section 13.

The operation control section 12 is adapted to determine a destination floor of the car room 1 based on the in-car call command signal 2*a* and the floor call command signal 31*a* outputted from the input circuit 11, and output destination floor information 12*a* to the travel distance calculating section 13.

The travel distance calculating section 13 is adapted to calculate the travel distance of the car room 1 moving up or down from a current position to a destination floor based on the car position command signal 3*a* outputted form the input circuit 11 and the destination floor information 12*a* outputted from the operation control section 12, and output travel distance information 13*a* indicating a calculated travel distance to the speed pattern generating section 14.

The speed pattern generating section 14 is adapted to determine a speed pattern indicating a time-series change in the speed of the car room 1 between a current position and a destination floor based on the travel distance information 13*a* outputted from the travel distance calculating section 13, then generate control information indicating a determined speed pattern, and output generated control information (hereinafter, referred to as a speed pattern 14*a*) to the output circuit 15.

Specifically, the speed pattern generating section 14 compares the travel distance of the car room 1 with a predetermined distance (later described as $L_a$), generates the speed pattern 14*a* of a normal operation if the travel distance is the same or less than the predetermined distance, generates the speed pattern 14*a* of a partially low speed operation if the travel distance is longer than the predetermined distance, and outputs a generated speed pattern 14*a* to the output circuit 15.

The speed pattern 14*a* of the normal operation is control information specifying that the car room 1 be accelerated up to a rated speed $V_r$ and moved for a while at the rated speed $V_r$, and then decelerated until the car room 1 stops, as a solid line $a_1$ in FIG. 19 shows.

The speed pattern 14*a* of the partially low speed operation is control information specifying that the car room 1 be accelerated up to the rated speed $V_r$ and moved for a while at the rated speed $V_r$; and after that, the car room 1 should be decelerated to a predetermined low speed $V_s$, which is lower than the rated speed V, then moved for a while at the predetermined low speed $V_s$, and decelerated until the car room 1 stops, as shown in FIG. 4.

The predetermined distance indicates a difference in height corresponding to a difference in air pressure (an amount of change in air pressure) that causes the Eustachian tube of a passenger in the car room 1 to open.

The output circuit 15 (a speed control section) outputs the speed pattern 14*a* outputted from the speed pattern generating section 14 to the speed control circuit 24.

The speed control circuit 24 (a speed control section) controls the hoist 23 based on the speed pattern 14*a* outputted from the output circuit 15.

The hoist 23, under the control of the speed control circuit 24, winds up a rope 21 balancing the car room 1 and a counterweight 22 so that the car room 1 is moved up or down to a destination floor at a speed corresponding to the speed pattern 14*a*.

FIG. 2 shows a flow chart of an elevator control method according to the first embodiment.

An elevator control method, in which the elevator apparatus 9 of the first embodiment makes the car room 1 move up or down to a destination floor by a specific speed pattern, will be described below with reference to FIG. 2.

<S110: Destination Floor Determining Process>

First, the operation control section 12 of the operation control circuit 10 determines the destination floor of the car room 1.

The destination floor determining process (S110) will be described below in detail.

Upon the operation of the in-car control panel 2 in the car room 1 by a passenger, the in-car control panel 2 outputs the in-car call command signal 2*a* indicating a designation floor designated by the passenger as the destination floor of the car room 1 to the input circuit 11 of the operation control circuit 10.

Upon the operation of the floor control panel 31 at an elevator lobby by an elevator user (hereinafter, referred to as a passenger) waiting for an elevator car, the floor control panel 31 outputs the floor call command signal 31*a* indicating an installation floor of the floor control panel 31 as the starting floor of the car room 1 to the input circuit 11 of the operation control circuit 10.

The input circuit 11 of the operation control circuit 10 receives the in-car call command signal 2*a* from the in-car control panel 2, and receives the floor call command signal 31*a* from the floor control pane 31.

The input circuit 11 of the operation control circuit 10 outputs the received in-car call command signal 2*a* or the received floor calf command signal 31*a* to the operation control section 12.

The operation control section 12 determines the destination floor of the car room 1 based on the in-car call command signal 2*a* or the floor call command signal 31*a* received from the input circuit 11.

For example, the operation control section 12 treats the designation floor designated by the in-car call command signal 2*a* as the destination floor of the car room 1. The operation control section 12 also treats the starting floor indicated by the floor call command signal 31*a* as the destination floor of the car room 1.

The operation control section 12 outputs the destination floor information 12*a* indicating the determined destination floor of the car room 1 to the travel distance calculating section 13.

<S120: Travel Distance Calculating Process>

The travel distance calculating section 13 of the operation control circuit 10 calculates the travel distance of the car room 1 from a current position to a destination floor.

The travel distance calculating process (S120) will be described below in detail.

Upon the output of the in-car command signal 2*a* from the in-car control panel 2 to the input circuit 11, or upon the output of the floor call command signal 31*a* from the floor control panel 31 to the input circuit 11, in S110, the car position detection circuit 3 detects a current position (the starting floor) of the car room 1, and outputs the car position command signal 3*a* indicating a detected current position of the car room 1 to the input circuit 11.

The input circuit 11 of the operation control circuit 10 outputs the car position command signal 3*a* received from the car position detection circuit 3 to the travel distance calculating section 13.

The travel distance calculating section 13 calculates the travel distance of the car room 1 from a current position to a destination floor based on the destination floor information 12*a* (S110) received from the operation control section 12 and the car position command signal 3*a* received from the input circuit 11.

For example, the stopping position of the car room 1 at each floor may be stored in the storage. The travel distance calculating section 13 specifies the stopping position of the car room 1 at the destination floor indicated by the operation control section 12 with reference to the storage, and calculates a distance from the current position of the car room 1 indicated by the car position command signal 3*a* to a specified stopping position of the car room 1 to determine the travel distance of the car room 1.

Specifically, for example, the current position of the car room 1 and the stopping position at the destination floor of the car room 1 may be measured as the height of the car room 1 from the bottom floor of the hoistway within which the car room 1 moves up and down. The travel distance calculating section 13 may calculate an absolute value ($|L_1-L_2|$) of a difference between a current position ($L_1$) of the car room 1 and a stopping position ($L_2$) of the car room 1 at the destination floor to determine a travel distance L of the car room 1.

The travel distance calculating section 13 outputs the travel distance information 13*a* indicating the travel distance L of the car room 1 calculated by the travel distance calculating section 13 to the speed pattern generating section 14.

<S130: Speed Pattern Generating Process>

The speed pattern generating section 14 of the operation control circuit 10 determines the speed pattern of the car room 1 from the current position to the destination floor based on the travel distance L of the car room 1, and then generates control information indicating a determined speed pattern as the speed pattern 14*a*.

The speed pattern generating process (S130) will be described below in detail.

FIG. 3 shows a flow chart of the speed pattern generating process (S130) according to the first embodiment.

The speed pattern generating process (S130) of the first embodiment will be described below with reference to FIG. 3.

<S131: Travel Distance Judging Process>

The speed pattern generating section 14 receives the travel distance information 13*a* from the travel distance calculating section 13, and compares the travel distance L indicated by the received travel distance information 13*a* with a first threshold $L_a$.

The first threshold $L_a$ indicates a predetermined distance set in advance. The first threshold $L_a$ will be discussed later in detail.

<S132: Speed Pattern Generating Process A>

If the value of the travel distance is larger than the first threshold (YES: $L>L_a$) in S131, then the speed pattern generating section 14 generates control information indicating that the car room 1 should be made to move up or down by the speed pattern of the partially low speed operation (see 41 of FIG. 4) as the speed pattern 14*a*.

The speed pattern of the partially low speed operation will be discussed later in detail.

<S133: Speed Pattern Generating Process B>

If the value of the travel distance is the same or lower than the first threshold (NO: $L \leqq L_a$), then the speed pattern generating section 14 generates control information indicating that the car room 1 should be moved up and down by the speed pattern of the normal operation (see the solid line $a_1$ of FIG. 19) as the speed pattern 14*a*.

<S134: Speed Pattern Outputting Process>

The speed pattern generating section 14 outputs the speed pattern 14*a* of the partially low speed operation generated in S132 or the speed pattern 14*a* of the normal operation generated in S133 to the output circuit 15.

The elevator control method will be described further with reference to FIG. 2.

<S140: Speed Control Process>

The output circuit 15 of the operation control circuit 10 outputs the speed pattern 14*a* to the speed control circuit 24, which thereby controls the hoist 23 based on the speed pattern 14*a* so that the car room 1 is moved up or down to the destination floor at a speed corresponding to the speed pattern 14*a*.

The speed control process (S140) will be discussed below in detail.

The output circuit 15 of the operation control circuit 10 receives the speed pattern 14*a* from the speed pattern generating section 14, and outputs the received speed pattern 14*a* to the speed control circuit 24.

The speed control circuit 24 makes the rotor of the hoist 23 rotate based on the speed pattern 14*a* received from the output circuit 15 of the operation control circuit 10 so that the hoist 23 makes the car room 1 move up or down at a speed corresponding to the speed pattern 14*a*.

The hoist 23, under the control of the speed control circuit 24, makes the rotor rotate and thereby wind up the rope 21 balancing the car room 1 so that the car room 1 is moved up or down to a destination floor at a speed corresponding to the speed pattern 14*a*.

FIG. 4 shows a graph of a speed pattern 41 of the partially low speed operation according to the first embodiment.

FIG. 5 shows a graph of a travel pattern 42 of the partially low speed operation according to the first embodiment.

FIG. 6 shows a graph of an air pressure pattern 43 of the partially low speed operation according to the first embodiment.

The speed pattern 41 of the partially low speed operation according to the first embodiment will be described below with reference to FIG. 4 to FIG. 6.

Referring to FIG. 4 to FIG. 6, the horizontal axis is the time axis indicating a period of time from the start of the car room 1, ascending or descending.

The vertical axis in FIG. 4 indicates the travel speed of the car room 1. In FIG. 5, the vertical axis indicates the travel position of the car room 1. In FIG. 6, the vertical axis indicates an absolute value of an amount of change in air pressure.

The control information (speed pattern 14*a*) causing the car room 1 to move up or down by the speed pattern 41 of the partially low speed operation is generated when the value of the travel distance (L) of the car room 1 is larger than the first threshold value ($L_a$) (S132: speed pattern generating process A).

As shown in FIG. 4, the speed pattern 41 of the partially low speed operation indicates an operation as follows. The car room 1 is accelerated up to the rated speed $V_r$ and continued to move for a while (time $t_c$), then decelerated to the predetermined low speed $V_s$, which is lower than the rated speed $V_r$, (time $t_a$) and continued to move for a while, and further decelerated until the car room 1 stops (time $t_z$).

With further reference to FIG. 4, $t_d$ denotes a time to start a deceleration from the rated speed $V_r$ to the low speed $V_s$ (deceleration starting time), $t_a$ denotes a time to end the deceleration to the low speed $V_s$, and $t_z$ denotes a time of the car room 1 reaching the destination floor (destination floor reaching time).

When the car room 1 is "descended" to a destination floor (during a descending operation), the car room 1 controlled by the speed pattern 41 of the partially low speed operation is descended from the current position ($L_1$) to the stopping position ($L_2$) at the destination floor as the travel pattern 42 of the partially low speed operation in FIG. 5 shows. Specifically, the car room 1 is descended down at the rated speed $V_r$ (including acceleration for starting and deceleration to the low speed $V_s$) until the time $t_a$ according to the speed pattern 41 of the partially low speed operation, first. Then, the car room 1 is gently descended further down at the low speed $V_s$ (including deceleration for reaching the destination floor) until the destination floor reaching time $t_z$.

When the car room 1 is "ascended" to a destination floor (during an ascending operation), the descending of the travel pattern 42 of the partially low speed operation of FIG. 5 is turned upside down. Specifically, the car room 1 is ascended up at the rated speed $V_r$ (including acceleration and deceleration) until the time $t_a$, first. Then, the car room 1 is gently ascended further up at the low speed $V_s$ (including deceleration for reaching the destination floor) until the destination floor reaching time $t_z$ A further description will be given below with reference to an example where the car room 1 is "descended".

Referring to FIG. 5, $t_a$ is defined as a time required for making the car room 1 descend for a distance $L_a$ at the rated speed $V_r$ (including acceleration and deceleration). Hereinafter, the time $t_a$ will be referred to as "$L_a$ reaching time".

The deceleration starting time $t_d$ is defined as a time preceding the $L_a$ reaching time by a period of time required for decelerating the car room 1 from the rated speed $V_r$ to the low speed $V_s$.

Air pressure in the car room 1 is almost equal to the outside atmospheric pressure unless controlled by a fan or the like. When the car room 1 is descended and air pressure outside the car room 1 (hereinafter, referred to as atmospheric pressure) is increased, air pressure in the car room 1 is increased. When the car room 1 is ascended, air pressure in the car room 1 is reduced as atmospheric pressure gets low.

Air pressure in the car room 1 when descending as shown by the travel pattern 42 of the partially low speed operation is increased as the air pressure pattern 43 of the partially low speed operation shows in FIG. 6. More specifically, air pressure in the car room 1 when descending as shown by the travel pattern 42 of the partially low speed operation is increased by $P_a$ until the $L_a$ reaching time first, and then gently further increased until the destination floor reaching time $t_z$.

When the car room 1 is ascended, the air pressure pattern 43 of the partially low speed operation of FIG. 6 is turned upside down. Specifically, air pressure in the car room 1 is reduced until the $L_a$ reaching time $t_a$ by $P_a$, and then further reduced gently until the destination reaching time $t_z$.

It is noted that $P_a$ denotes a first amount of change in air pressure causing the Eustachian tube to open (first air pressure opening the Eustachian tube) in response to ear block discomfort (which is also called "ear fullness" or "ear popping").

The ear block discomfort is caused when the eardrum is made bulge outward on the outer ear side (part of the ear external to the eardrum) or retract inward on the middle ear side (part of the ear internal to the eardrum) by an air pressure difference between the outer ear side and the middle ear side of the eardrum.

The ear block discomfort is removed by taking outside air into the middle ear to balance air pressure between the middle ear side and the outer ear side. This is done by an "active opening of the Eustachian tube" under conscious control or a "passive opening of the Eustachian tube" under an automatic organ functional control.

The "active opening of the Eustachian tube" is done when air pressure becomes higher on the outer ear side than on the middle ear side (when the car room 1 is descended). The "passive opening of the Eustachian tube" is done when air pressure becomes lower on the outer ear side than on the middle ear side (when the car room 1 is ascended).

The "active opening of the Eustachian tube" is usually done by swallowing or yawning, which is commonly called "ear clearing".

The opening of the Eustachian tube may be needed once or more times if the travel distance L of the car room 1 is long and therefore air pressure in the car room 1 has a large amount of change.

The elevator apparatus 9 is thus adapted to control the operation of the car room 1 by using the speed pattern 41 of the partially low speed operation. This may allow an amount of change per unit time in air pressure in the car room 1 to be reduced after inviting the first opening of the Eustachian tube of a passenger in the car room 1.

This may allow the interval between the first ear clearing and the second ear clearing to be prolonged. More specifically, the period of time between the time $t_a$ and the time $t_{a2}$ at is allowed to be extended, where $t_a$ is the time taken to change air pressure in the car room 1 by $P_a$, which is the amount of change in air pressure causing the first opening of the Eustachian tube, and $t_{a2}$ is the time taken to change air pressure in the car room 1 by $P_{a2}$, which is the amount of change in air pressure causing the second opening of the Eustachian tube.

Thus, the elevator apparatus 9 may alleviate the ear block discomfort of passengers in the car room 1.

There are some variations in the amount of change in air pressure causing the Eustachian tube to open. It is thought that a value between 2000 Pa (Pascal) and 4800 Pa (or between 2400 Pa and 3000 Pa) is desirable for the first air pressure $P_a$ opening the Eustachian tube during a descending operation. During an ascending operation, a value around 2000 Pa is thought to be desirable for the first air pressure $P_a$ opening the Eustachian tube.

It is also noted that $L_a$ in FIG. 5 denotes a difference in height (first height difference opening the Eustachian tube) corresponding to $P_a$, the first air pressure opening the Eustachian tube. $L_a$ has a set value between 150 meters and 250 meters during a descending operation, and a value around 150 meters during an ascending operation.

It is also noted that the low speed $V_s$ in FIG. 4 may be desirable to be set to a speed as fast as the car room 1 would not take too much time to reach the destination floor, and as slow as a sufficient interval would be allowed for ear clearing.

The low speed $V_s$ may alternatively be changed according to the travel distance L of the car room 1. For example, the low speed $V_s$ may be set to a predetermined first speed ($<V_r$) if the travel distance L is very long, and the low speed $V_s$ may be set to a predetermined second speed (<the first speed) if the travel distance L is relatively short (if $L>L_a$ is satisfied).

The elevator apparatus 9 of the first embodiment may also be described as follows.

The elevator apparatus 9 may include a means for making an elevator car move up and down within a hoistway. The elevator apparatus 9 may also include the speed pattern generating section 14 that may generate the predetermined running speed pattern of an elevator, and the travel distance calculating section 13 that may calculate the travel distance L between a starting floor and a destination floor of the car room 1.

If the travel distance calculating section 13 calculates a value of the travel distance L, which exceeds the predetermined distance $L_a$, then the elevator apparatus 9 may control the speed pattern generating section 14 so that the car room 1 moves at a rated speed from a starting floor to the vicinity of the predetermined distance $L_a$, and then move at a speed reduced from the rated speed after the vicinity of the predetermined distance $L_a$.

This may reduce the travel time compared to the case where an elevator car is moved all the way at a low speed (see a dotted line $a_2$ in FIG. 19) as a remedy against ear block discomfort of the passengers, thereby thus improving the operational efficiency of elevators.

This may also allow the interval of ear clearing to be prolonged, thereby thus alleviating the passenger's discomfort.

It is also advantageous that the elevator apparatus 9 do not need to be equipped with an air supply fan and an air exhaust fan for controlling air pressure in the car room 1. This may thus allow a reduction in the size and weight of the car room 1, and also achieve a reduction in the cost of the elevator apparatus 9.

Embodiment 2

In a second embodiment, a description will be given of a case where the car room 1 is moved based on different speed patterns between ascending and descending.

It is noted that new features that have not been discussed in the first embodiment will be elaborated exclusively in this embodiment. Features omitted in the description should therefore be regarded as the same as those discussed in the first embodiment.

FIG. 7 shows a flow chart of the speed pattern generating process (S130) according to the second embodiment.

The speed pattern generating process (S130) of the second embodiment will be discussed below with reference to FIG. 7.

It is noted that the travel distance calculating section 13 outputs the travel distance information 13*a* indicating the travel distance L of the car room 1, the current position $L_1$ of the car room 1, and the stopping position $L_2$ of the car room 1 at a destination floor, to the speed pattern generating section 14.

<S131*b*: Ascending/Descending Judging Process>

The speed pattern generating section 14 receives the travel distance information 13*a* from the travel distance calculating section 13, and compares the current position $L_1$ of the car room 1 with the stopping position $L_2$ of the car room 1 at the destination floor indicated by the received travel distance information 13*a*.

<S132*b*: Travel Distance Judging Process>

When it is judged in S131*b* that the value of the current position is larger than the value of the stopping position at the destination floor, that is, the car room 1 is descended (NO: $L_1>L_2$), the speed pattern generating section 14 compares the travel distance L indicated by the travel distance information 13*a* with the first threshold $L_a$.

<S133*b*: Speed Pattern Generating Process A>

When it is judged in S132*b* that the value of the travel distance is larger than the first threshold (YES: $L>L_a$), the speed pattern generating section 14 generates control information indicating that the car room 1 should be moved by the speed pattern of the partially low speed operation (see 41 in FIG. 4) as the speed pattern 14*a*.

<S134*b*: Speed Pattern Generating Process B>

When it is judged in S131*b* that the value of the current position is less than the value of the stopping position at the destination floor, that is, the car room 1 is ascended (YES: $L_1<L_2$), and when it is judged in S132*b* that the value of the travel distance is the same or less than the first threshold (NO: $L\leqq L_a$), the speed pattern generating section 14 generates control information indicating that the car room 1 should be moved by the speed pattern of the normal operation (see the solid line $a_1$ in FIG. 19) as the speed pattern 14*a*.

<S135*b*: Speed Pattern Output Process>

The speed pattern generating section 14 outputs the speed pattern 14*a* of the partially low speed operation generated in S133*b* or the speed pattern 14*a* of the normal operation generated in S134*b*, to the output circuit 15.

In the second embodiment, if the car room 1 is intended to ascend, the speed pattern generating section 14 of the operation control circuit 10 generates the speed pattern 14*a* of the normal operation so that the car room 1 is ascended to the destination floor by the normal operation.

It is widely believed that the ear block discomfort is not so serious during the ascending of the car room 1 (when air pressure in the car room 1 decreases) as during the descending of the car room 1 (when air pressure in the car room 1 increases).

Given this fact, it may also be effective to prioritize a reduction in time to reach the destination floor rather to the alleviation of the ear block discomfort, and the car room 1 may be moved by the normal operation.

Embodiment 3

In a third embodiment, a description will be given of a case where the car room 1 is equipped with an air supply fan, and air pressure in the car room 1 is controlled based on a combination of speed control by the speed pattern and pressure control by the air supply fan.

It is noted that new features that have not been discussed in the first and second embodiments will be elaborated mainly in this embodiment. Features omitted in the description should therefore be regarded as the same as those discussed in the first or second embodiments.

FIG. 8 shows a configuration of the elevator apparatus 9 according to the third embodiment.

The configuration of the elevator apparatus 9 of the third embodiment will be described below with reference to FIG. 8.

The car room 1 is provided with an air supply fan 5 to increase air pressure in the car room 1 by supplying air into the car room 1, and an air pressure control circuit 4 to control the air supply fan 5. The air pressure control circuit 4 and the air supply fan 5 are installed as an air pressure control apparatus 7.

The operation control circuit 10 further includes an air pressure control setting section 16.

The air pressure control setting section 16 compares the travel distance L with the first height difference $L_a$ opening the Eustachian tube when the car room 1 is descended to the destination floor. If the travel distance L is larger than the first height difference $L_a$ opening the Eustachian, then the air pressure control setting section 16 sends a command to the air pressure control circuit 4, thereby supplies air into the car room 1, and increases air pressure in the car room 1 up to the first air pressure P opening the Eustachian tube.

The air pressure control setting section 16 thus increases air pressure in the car room 1 to the first air pressure $P_a$ opening the Eustachian tube, and then further increases the air pressure in the car room 1 by an amount of increased pressure that makes the amount of raised pressure per unit time (an air pressure rising rate) of air pressure in the car room 1 equal to the amount of increased pressure per unit time of air pressure in the car room 1 when the car room 1 is descended at the low speed $V_s$, where the air pressure rising rate is based on a sum of the amount of raised pressure of air pressure in the car room 1 under pressure control and the amount of raised pressure of air pressure in the car room 1 according to the descending of the car room 1.

The speed pattern generating section 14 of the operation control circuit 10 compares the travel distance L with a predetermined second distance $L_b$, which is longer than the first height difference $L_a$ opening the Eustachian tube, when the car room 1 is descended to the destination floor. Then, the speed pattern generating section 14 generates the speed pattern 14*a* of the normal operation if the travel distance L is the same or less than the predetermined second distance. If the travel distance L is larger than the predetermined second distance, the speed pattern generating section 14 generates the speed pattern 14*a* of the partially low speed operation.

The speed pattern 14*a* of the partially low speed operation shows that the car room 1 reaches the low speed $V_s$ when air pressure in the car room 1 becomes equal to the outside air pressure of the car room 1.

The other elements of the elevator apparatus 9 are configured the same as those discussed in the first embodiment.

FIG. 9 shows a configuration of the car room 1 according to the third embodiment.

Referring to FIG. 9, the air supply fan 5, the air pressure control circuit 4 for controlling the air supply fan 5, and an air supply duct 6 for sending air from the air supply fan 5 into the car room 1 are installed on a ceiling portion of the car room 1 as the air pressure control apparatus 7.

The air pressure control circuit 4 is adapted to control the air supply fan 5 so that air is supplied to the car room 1 and thereby air pressure in the car room 1 is increased.

FIG. 10 shows a flow chart of an elevator control method according to the third embodiment.

The elevator control method according to the third embodiment will be described below with reference to FIG. 10. In the elevator control method, the operation control circuit 10 controls the operation of an elevator so that the car room 1 is moved to a destination floor by a specific speed pattern, and air pressure in the car room 1 is increased by a specific pressure pattern.

In the third embodiment, the following processes (S150 to S160) are executed in addition to the processes (S110 to S140) discussed in the first embodiment.

It is noted however that the speed pattern generating process (S130) of the third embodiment modifies that of the first embodiment, and therefore will be described separately later in detail.

<S150: Air Pressure Control Setting Process>

The air pressure control setting section 16 of the operation control circuit 10 determines a pressure pattern to be applied to the car room 1 based on the travel distance of the car room 1, and generates control information indicating a determined pressure pattern as a pressure pattern 16*a*.

<S160: Air Pressure Control Process>

The output circuit 15 of the operation control circuit 10 outputs the pressure pattern 16*a* to control the air pressure control circuit 4. The air pressure control circuit 4 then controls the air supply fan 5 based on the pressure pattern 16*a*, and also controls air pressure in the car room 1 by an amount of increased pressure corresponding to the pressure pattern 16*a*.

The air pressure controlling process (S160) will be described below in detail.

The output circuit 15 of the operation control circuit 10 receives the pressure pattern 16*a* from the air pressure control setting section 16, and outputs the received pressure pattern 16*a* to the air pressure control circuit 4.

The air pressure control circuit 4 receives the pressure pattern 16*a* from the output circuit 15 of the operation control circuit 10, and controls the air supply fan 5 based on the received pressure patter 16*a* so that the air supply fan 5 rotates to supply air into the car room 1.

FIG. 11 shows a flow chart of the speed pattern generating process (S130) according to the third embodiment.

The speed pattern generating process (S130) of the third embodiment will be elaborated below with reference to FIG. 11.

<S131*c*: Ascending/Descending Judging Process>

The speed pattern generating section 14 receives the travel distance information 13*a* from the travel distance calculating section 13, and compares the current position $L_1$ of the car room 1 indicated by the received travel distance information 13*a* with the stopping position $L_2$ of the car room 1 at a destination floor.

<S132*c*: Ascending Distance Judging Process>

When it is judged in S131*c* that the value of the current position is the same or less than the stopping position at the destination floor, that is, the car room 1 is ascended (YES: $L_1>L_2$), the speed pattern generating section 14 compares the travel distance L indicated by the travel distance information 13*a* with the first height difference $L_a$ (threshold) opening the Eustachian tube.

<S133*c*: Speed Pattern Generating Process A>

When it is judged in S132*c* that the travel distance L is larger than the first height difference $L_a$ opening the Eustachian tube (YES), the speed pattern generating section 14 generates the speed pattern 14*a* of the partially low speed operation discussed in the first embodiment.

<S134*c*: Speed Pattern Generating Process B>

When it is judged in S132*c* that the travel distance L is the same or less than the first height difference $L_a$ opening the Eustachian tube (NO: $L \leqq L_a$), the speed pattern generating section 14 generates the speed pattern 14*a* of the normal operation discussed in the first embodiment.

<S135*c*: Descending Distance Judging Process>

When it is judged in S131*c* that the value of the current position is the same or less than the value of the stopping position at the destination floor, that is, the car room 1 is descended (NO: $L_1>L_2$), the speed pattern generating section 14 compares the travel distance L indicated by the travel distance information 13*a* with the predetermined second threshold $L_b$, which is larger than the first height difference $L_a$ opening the Eustachian tube.

The second threshold $L_b$ will be elaborated later in detail.

If the value of the travel distance is the same or less than the second threshold (NO: $L \leqq L_b$), then the speed pattern generating section 14 generates the speed pattern 14*a* of the normal operation in S134*c*.

<S136*c*: Speed Pattern Generating Process C>

When it is judged in S135*c* that the value of the travel distance is larger than the second threshold (YES: $L>L_b$), the speed pattern generating section 14 generates the speed pattern 14*a* of the partially low speed operation.

It is noted however that that speed pattern 14*a* of the partially low speed operation generated in this embodiment indicates that the car room 1 should be moved for a longer period of time at the rated speed than the case of the first embodiment.

The speed pattern 14*a* generated in the speed pattern generating process C (S136*c*) will be referred to as a "speed pattern 14*a* of the partially low speed operation (under pressure control)".

The speed pattern 14*a* of the partially low speed operation (under pressure control) will be elaborated later in detail.

<S137*c*: Speed Pattern Output Process>

The speed pattern generating section 14 outputs the speed pattern 14*a* of the partially low speed operation generated in S133*c*, the speed pattern 14*a* of the normal operation generated in S134*c*, or the speed pattern 14*a* of the partially low speed operation (under pressure control) generated in S136*c*.

FIG. 12 shows a flow chart of the air pressure control setting process (S150) according to the third embodiment.

The air pressure control setting process (S150) of the third embodiment will be described below with reference to FIG. 12.

<S151*c*: Ascending/Descending Judging Process>

The air pressure control setting section 16 receives the travel distance information 13*a* from the travel distance calculating section 13, and compares the current position $L_1$ of the car room 1 indicated by the received travel distance information 13*a* with the stopping position $L_2$ of the car room 1 at the destination floor.

<S152*c*: Travel Distance Judging Process>

When it is judged in S151*c* that the value of the current position is larger less than the value of the stopping position at the destination floor, that is, the car room 1 is descended (NO: $L_1>L_2$), the air pressure control setting section 16 compares the travel distance L indicated by the travel distance information 13*a* with the first height difference $L_a$ (threshold) opening the Eustachian tube.

<S153*c*: Pressure Pattern Generating Process>

When it is judged in S152*c* that the travel distance L is larger than the first height difference $L_a$ opening the Eustachian tube (YES), the air pressure control setting section 16 generates control information indicating that air pressure in the car room 1 should be increased by a predetermined pressure pattern (see 48 in FIG. 17) as the pressure pattern 16*a*.

<S154*c*: Pressure Pattern Output Process>

The air pressure control setting section 16 outputs the pressure pattern 16*a* generated in S153*c* to the output circuit 15.

When it is judged in S151*c* that the current position $L_1$ is the same or less than the stopping position $L_1$ at the destination floor (YES), and when it is judged in S152*c* that the travel distance L is the same or less than the first height difference L opening Eustachian tube (NO), the air pressure control setting section 16 will not generate the pressure pattern 16*a*, which terminates the process.

FIG. 13 shows a table of a speed control and a pressure control implemented in the elevator control method according to the third embodiment.

The speed control and the pressure control corresponding to travel distance will be described below with reference to FIG. 13.

A description will be given first of a case where the car room 1 is ascended.

If the travel distance L is the same or less than the first height difference $L_a$ opening the Eustachian tube, then the car room 1 is ascended by the normal operation, and air pressure in the car room 1 is not increased by the air pressure control.

If the travel distance L is larger than the first height difference $L_a$ opening the Eustachian tube, then the car room 1 is ascended by the partially low speed operation, and air pressure in the car room 1 is not increased by the air pressure control.

A description will now be given of a case where the car room 1 is descended.

If the travel distance L is the same or less than the first height difference $L_a$ opening the Eustachian tube, then the car room 1 is descended by the normal operation, and air pressure in the car room 1 is not increased by the air pressure control.

If the travel distance L is larger than the first height difference $L_a$ opening the Eustachian tube, and is also the same or less than the second threshold $L_b$, then the car room 1 is descended by the normal operation, and air pressure in the car room 1 is increased by the air pressure control.

If the travel distance L is larger than the second threshold $L_b$, then the car room 1 is descended by the partially low speed operation for increasing pressure, and air pressure in the car room 1 is increased by the air pressure control.

FIG. 14 shows a graph of a speed pattern 44 of the partially low speed operation (under pressure control) according to the third embodiment.

FIG. 15 shows a graph of a travel pattern 45 of the partially low speed operation (under pressure control) according to the third embodiment.

FIG. 16 shows a graph of an air pressure pattern 46 of the partially low speed operation (under pressure control) according to the third embodiment.

FIG. 17 shows a graph of a pressure pattern 48 according to the third embodiment.

The speed pattern 44 and the pressure pattern 48 of the partially low speed operation (under pressure control) will be described below with reference to FIG. 14 to FIG. 17.

Referring to FIG. 14 to FIG. 17, the horizontal axis is the time axis indicating a period of time from the start of the car room 1, ascending or descending.

In FIG. 14, the vertical axis indicates the travel speed of the car room 1. In FIG. 15, the vertical axis indicates the travel position of the car room 1. In FIG. 16, the vertical axis indicates an absolute value of an amount of change in air pressure. In FIG. 17, the vertical axis indicates an amount of increased pressure to air pressure in the car room 1.

The control information (14*a*) indicating that the car room 1 should be moved by the speed pattern 44 of the partially low speed operation (under pressure control) is generated if the value of the travel distance L of the car room 1 is larger than the second threshold $L_a$ (S136*c*: speed pattern generating process C).

As shown in FIG. 14, the speed pattern 44 of the partially low speed operation (under pressure control) shows the following operation. The car room 1 is accelerated up to the rated speed $V_r$ and continued to move for a while (time $t_d$), then decelerated to the predetermined low speed $V_s$, which is lower than the rated speed $V_r$, (time $t_c$) and continued to move for a while, and further decelerated until the car room 1 stops (time $t_z$).

It is noted that the low speed $V_s$ may be set to a speed as fast as the car room 1 would not take too much time to reach the destination floor, and as slow as a sufficient interval would be allowed for ear clearing, as described in the first embodiment.

In FIG. 16, the air pressure pattern 46 of the partially low speed operation (under pressure control) shows a sum of an amount of change in air pressure in the car room 1 according to the descending of the car room 1 by the speed pattern 44 of the partially low speed operation (under pressure control) (hereinafter, referred to as an "amount of air pressure change upon descending") and an amount of change in air pressure in the car room 1 controlled by the air supply fan 5 (hereinafter, referred to as an "amount of air pressure change under air pressure control").

The air pressure pattern 47 (indicated by a dashed-dotted line) of the partially low speed operation (without pressure control) shows the amount of air pressure change upon descending only. A difference between the air pressure pattern 46 of the partially low speed operation (under pressure control) and an air pressure pattern 47 of the partially low speed operation (without pressure control) indicates the amount of air pressure change under pressure control.

It is noted that $t_{a3}$ denotes a time required for increasing air pressure in the car room 1 by the first air pressure $P_a$ opening the Eustachian tube. Hereinafter, the time $t_{a3}$ will be referred to as "$P_a$ change time".

The $P_a$ change time $t_{a3}$ is defined as a time at which a sum of the amount of change in air pressure when descending and the amount of change in air pressure under pressure control becomes equal to the first air pressure $P_a$ opening the Eustachian tube.

More specifically, the $P_a$ change time $t_{a3}$ is defined as a time at which a sum of an accumulated total of amounts of air pressure change in the car room 1 when descending at the rated speed $V_r$ (including during acceleration) and an accumulated total of amounts of air pressure change in the car room 1 when increased by the rated output of the air supply fan 5 becomes equal to the first air pressure $P_a$ opening the Eustachian tube.

In FIG. 17, the pressure pattern 48 shows that air pressure in the car room 1 is increased by the rated output from the air supply fan 5 until the $P_a$ change time $t_{a3}$, and then the amount of increased pressure per unit time is reduced at a "predetermined rate".

The predetermined rate of the pressure pattern 48 is defined as a rate at which the air pressure pattern 46 of the partially low speed operation (under pressure control) has the same change rate as the change rate of air pressure in the car room 1 when the car room 1 is descended at the low speed $V_s$ (without pressure control).

It is noted that $t_c$ denotes a time at which the amount of increased pressure per unit time becomes 0 by reducing the pressure at the "predetermined rate". Hereinafter, $t_c$ will be referred to as "air pressure control ending time".

As shown in FIG. 14, the deceleration starting time $t_d$ of the speed pattern 44 of the partially low speed operation (under pressure control) is defined as a time preceding the pressure control ending time $t_c$ by a time required for decelerating the car room 1 from the rated speed $V_r$ to the low speed $V_s$.

It is also noted that the second threshold $L_b$ is defined as a distance from a starting point to the point which the car room 1 reaches when the car room 1 continues to decelerate from the deceleration starting time $t_d$.

Hereinafter, $L_b$ will be referred to as a "height differential threshold under pressure control".

A time $t_d'$ at which the speed reaches 0 when the car room 1 continues to decelerate from the deceleration starting time $t_d$ is called a "deceleration extending time".

A distance from the starting point to the point where the car room 1 reaches at the deceleration starting time $t_d$ is called a "reaching distance $L_d$ under deceleration".

If the travel distance L of the car room 1 is the same or less than the height differential threshold $L_b$ under pressure control ($t_z \leqq t_d'$ in FIG. 14), then the car room 1 is descended by the speed pattern of the normal operation and not by the speed pattern 44 of the partially low speed operation (under pressure control) since the car room 1 reaches the destination floor without moving at the low speed $V_s$.

Air pressure in the car room 1 whose speed is controlled by the speed pattern 44 of the partially low speed operation (under pressure control) (see FIG. 14) and whose inside air pressure is controlled by the pressure pattern 48 (see FIG. 17) is increased by the first air pressure $P_a$ opening the Eustachian tube up to the $P_a$ change time $t_{a3}$, and then after that increased further gently at a fixed rate, as indicated by a travel pattern 45 of the partially low speed operation (under pressure control) in FIG. 16. The pressure control ends at the pressure control ending time $t_c$, when air pressure in the car room 1 rises as the car room 1 is descended at the low speed $V_s$.

FIG. 18 shows a graph of an air pressure pattern 49 of a normal operation (under pressure control) according to the third embodiment.

When the travel distance L of the car room 1 is larger than the first height difference $L_a$ opening the Eustachian tube, but the same or less than the height differential threshold $L_b$ under pressure control, the speed of the car room 1 may be controlled by the speed pattern of the normal operation, and air pressure in the car room 1 may be controlled by the pressure pattern 48.

More specifically, air pressure in the car room 1 may be increased up to the $P_a$ change time $t_{a3}$ by the first air pressure $P_a$ opening the Eustachian tube, and then after that further increased gently at a fixed rate, as the air pressure pattern 49 (a solid line) of the normal operation (under pressure control) in FIG. 18 shows.

Alternatively, however, the pressure control may be performed as a long dashed line in FIG. 18 shows. Specifically, an output from the air supply fan 5 may be controlled so that air pressure in the car room 1 is increased by the amount of the first air pressure $P_a$ opening the Eustachian tube up to the time $t_a'$, which follows the $P_a$ change time $t_{a3}$ and precedes the $L_a$ reaching time $t_a$.

The elevator apparatus 9 of the third embodiment may also be described as follows.

The elevator apparatus 9 may include the means for making an elevator car move up and down within a hoistway. The elevator apparatus 9 may include the speed pattern generating section 14 that may generate the predetermined elevator running pattern; the travel distance calculating section 13 that may calculate the travel distance L from the starting floor of the car room 1 to the destination floor of the car room 1; the air supply fan 5 that may supply air outside the car room 1 into the car room 1; and the air pressure control circuit 4 that may control the air supply fan 5 so that air pressure in the car room 1 is controlled by the predetermined pressure pattern.

The elevator apparatus 9 may control the car room 1 when descending as follows. If the travel distance calculated by the travel distance calculating section 13 exceeds the predetermined distance $L_b$, the car room 1 may be made to move at the rated speed by the speed pattern generating section 14, and at the same time air pressure in the car room 1 is increased by the predetermined pressure pattern by the air pressure control circuit 4, up to the predetermined distance $L_b$ from the starting floor, and from there made to move at the low speed, which is slower than the rated speed, by the speed pattern generating section 14.

The elevator apparatus 9 controls the car room 1 when ascending as follows. If the travel distance L calculated by the travel distance calculating section 13 exceeds the predetermined distance $L_a$, the car room 1 may be made to move at the rated speed up to the vicinity of the predetermined distance $L_a$ from the starting floor, and from there made to move at the low speed, which is slower than the rated speed, by the speed pattern generating section 14.

Specifically, the elevator apparatus 9 may perform as follows.

During an ascending operation, the car room 1 is made to move to a destination floor based on the judgment of whether or not the partially low speed operation is implemented according to the travel distance ($|L_1-L_2|$), as discussed in the first embodiment.

During a descending operation, the difference between $L_1$ and $L_2$, i.e., $|L_1-L_2|$, is calculated by the travel distance calculating section 13 and then compared with the distance $L_a$.

Specifically, if $|L_1-L_2|<L_a$, then the car room 1 is made to move at the normal rated speed $V_r$ and the air pressure control circuit 4 is not operated.

If $|L_1-L_2|>L_a$, then $|L_1-L_2|$ is further compared with the distance $L_b$ ($>L_a$). If $|L_1-L_2|>L_b$, then air pressure in the car room 1 is increased up to the air pressure difference $P_a$ corresponding to the height difference $L_a$ by the time $t_{a3}$, which precedes the time $t_a$ required for the car room 1 to reach the distance $L_a$ from a starting floor, by using the air pressure control circuit 4 and the air supply fan 5. After the time $t_{a3}$, the amount of increased pressure is gradually reduced. At the time $t_c$ (at which air pressure inside the car room 1 becomes equal to air pressure outside the car room 1), the air pressure control of the car room 1 is stopped. Then, the car room 1 is started to decelerate from the rated speed $V_r$ at the time $t_d$ before and around the time $t_c$ (no matter which is larger between $t_d$ and $t_c$). The car room 1 is then switched to move at the low speed $V_s$, and the car room 1 is stopped at a destination floor.

The time $t_d'$ indicates the time required for the car room 1 to move at the rated speed $V_r$ up to the travel distance $L_b$ where the car room 1 is stopped, and therefore the time $t_d$ indicates the time to start decelerating the car room 1.

$L_b$ indicates the travel distance of the car room 1 when it starts decelerating at the rated speed $V_r$ from the time $t_d$ around $t_c$.

In such a series of operations, a passenger in the car room may be invited to the first ear clearing near the time $t_{a3}$ where air pressure in the car room 1 reaches the first air pressure $P_a$ opening the Eustachian tube. After that, air pressure in the car room 1 changes at a moderate rate, which allows the passenger to have a long interval before another ear clearing. This may alleviate the discomfort of the passengers.

Referring to existing air pressure control devices, both air supplying and air exhausting are necessary. This requires a set of an air supply fan and an air exhaust fan, or a set of a fan and a device for switching between supplying and exhausting air by the fan.

According to the third embodiment, on the other hand, only the air supply fan 5 is needed. This may allow the air pressure control apparatus installed in the car room 1 to be reduced in size and weight, and also contribute to energy saving.

As a remedy against the ear block discomfort of passengers, the travel time may be reduced compared to when a car room is made to move all the way at the low speed (see the dashed line $a_2$ in FIG. 19), thereby thus improving operational efficiency.

The sufficiently prolonged interval for ear clearing may effectively alleviate the ear block discomfort of passengers.

Thus, when the car room 1 is descended, "the normal operation", "the normal operation+the pressure control", and "the partially low speed operation+the pressure control" are switched therebetween based on the comparison of the travel distance L with the first height difference $L_a$ opening the Eustachian tube and the height differential threshold $L_b$ under pressure control.

If the car room 1 is provided with an air exhaust fan, and when the car room 1 is ascended, then "the normal operation", "the normal operation+the pressure control", and "the partially low speed operation+the pressure control" are switched therebetween, likewise, based on the comparison of the travel distance L with the first height difference $L_a$ opening the Eustachian tube and the height differential threshold $L_b$ under pressure control.

The car room 1 may also be ascended by the normal operation in the same manner as that discussed in the second embodiment, regardless of whether the travel distance L is larger than the first height difference $L_a$ opening the Eustachian tube.

BRIEF DESCRIPTION OF THE DRAWINGS

FIG. 13 shows a table of a speed control and a pressure control used in the elevator control method according to the third embodiment;

EXPLANATION OF REFERENCE NUMERALS

Figure 1:
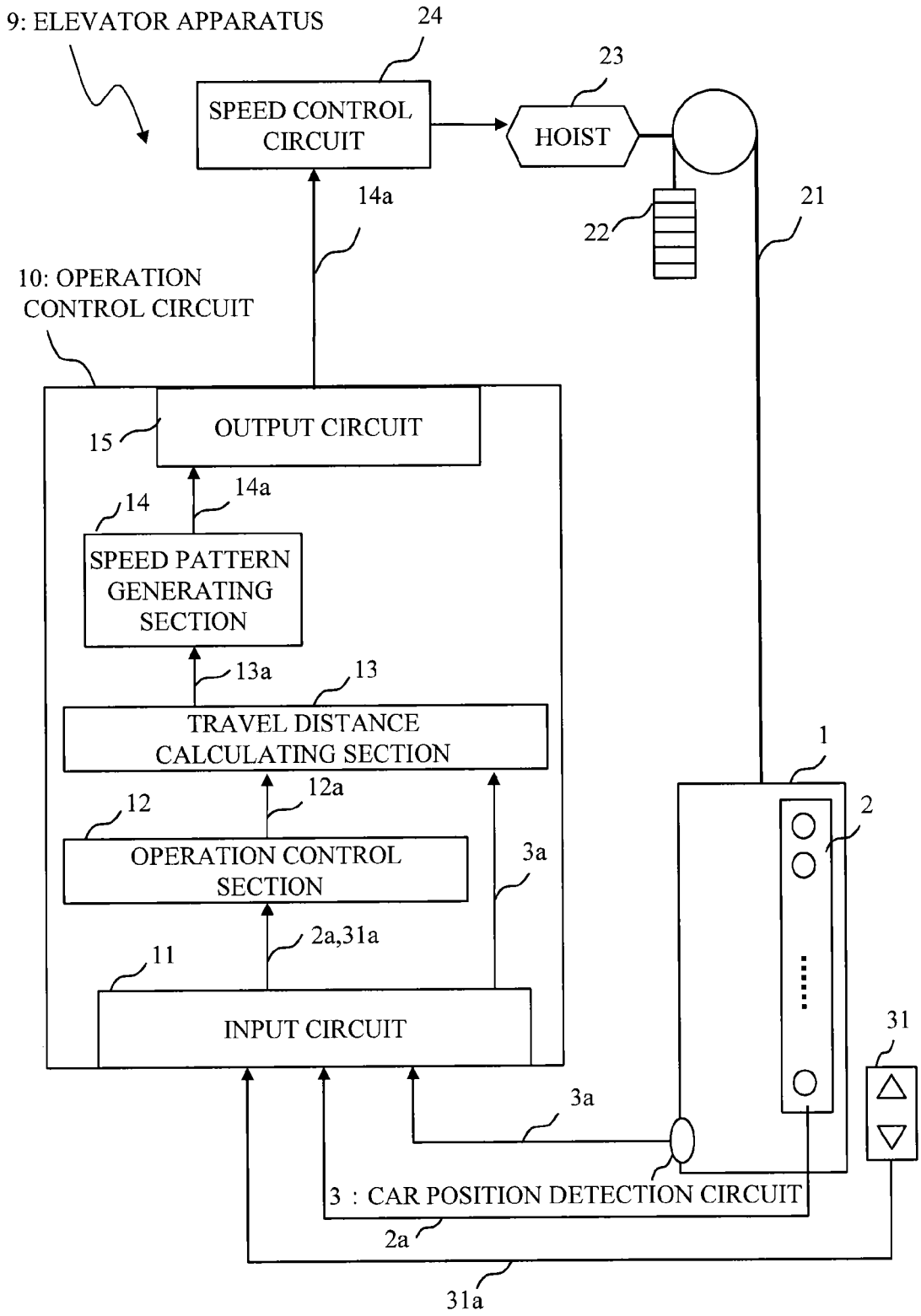
FIG. 1 shows a configuration of an elevator apparatus 9 according to a first embodiment.
Figure 2:
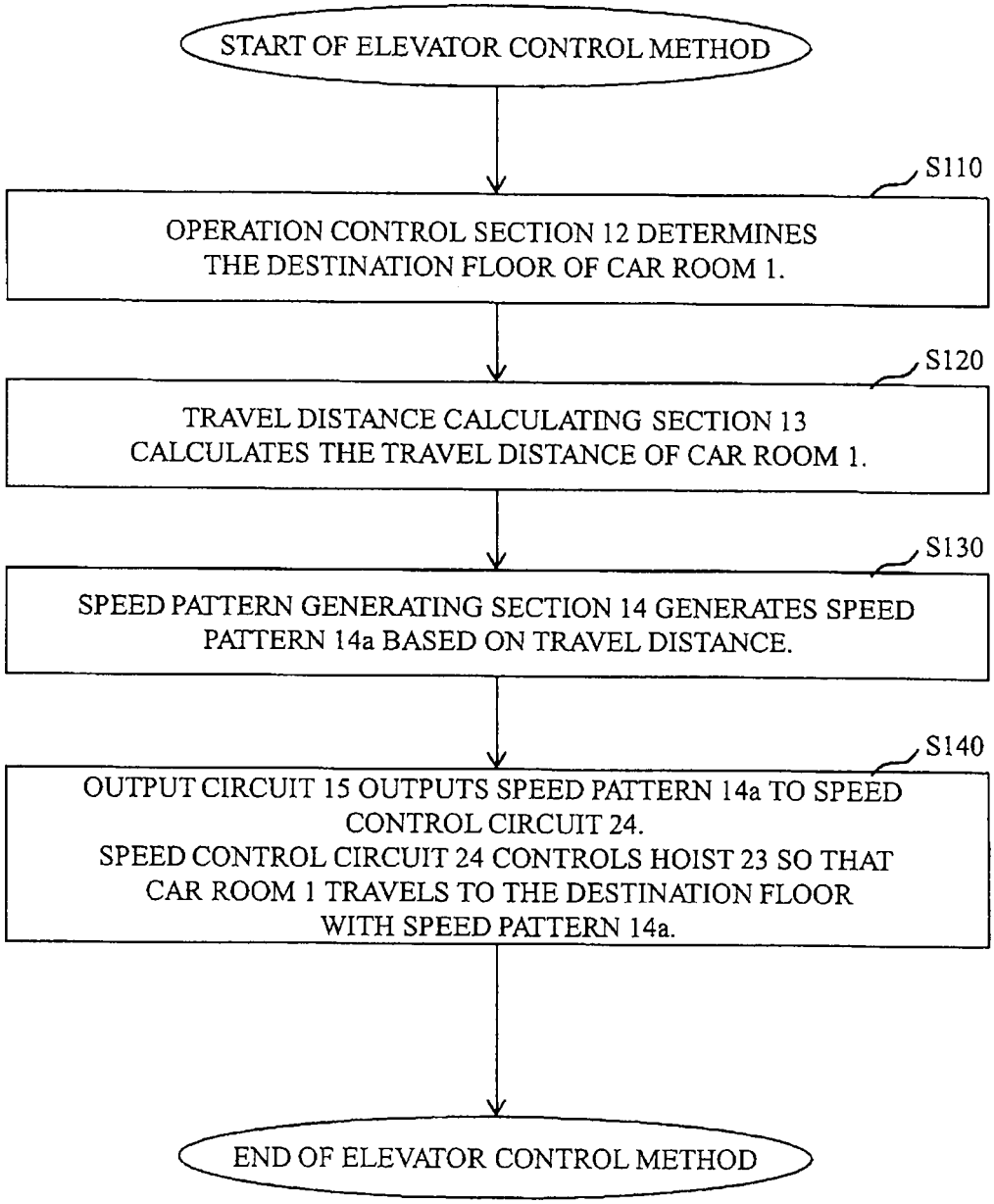
FIG. 2 shows a flow chart of an elevator control method according to the first embodiment.
Figure 3:
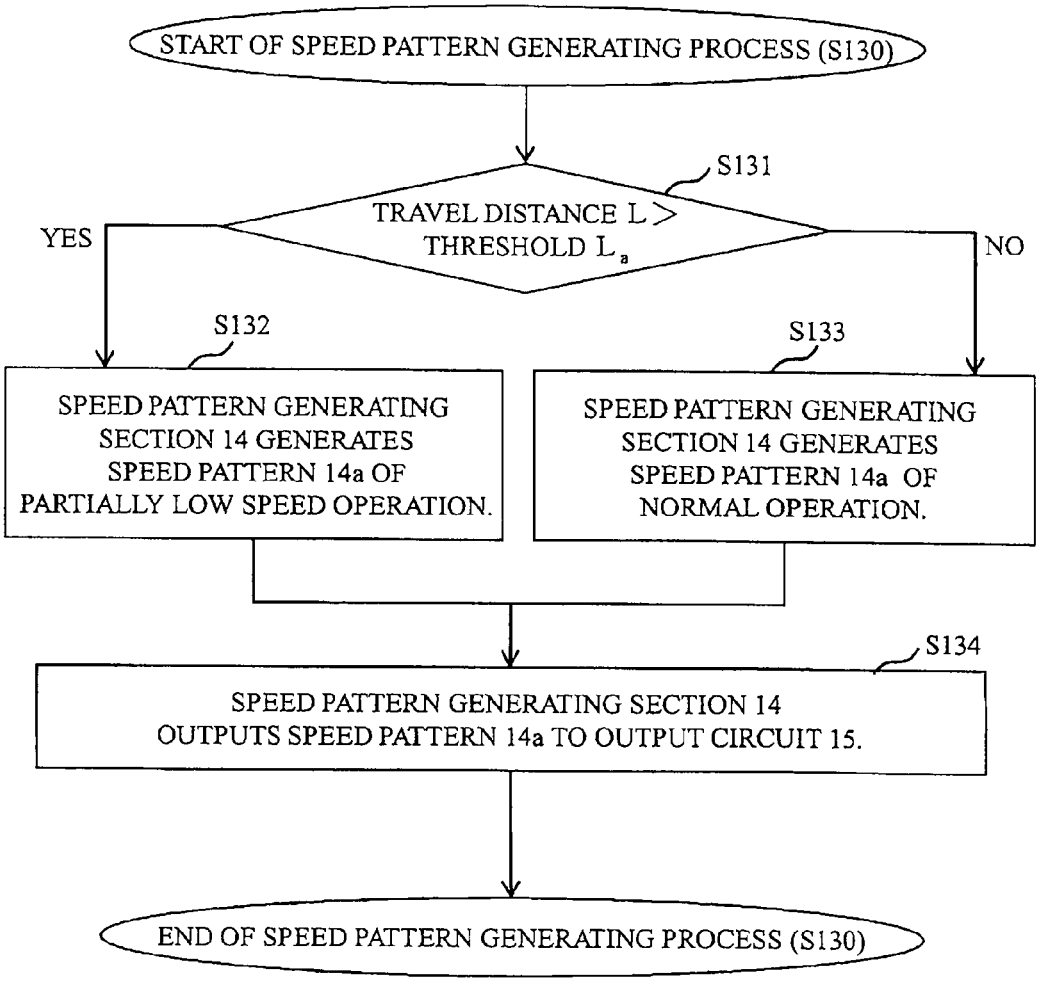
FIG. 3 shows a flow chart of a speed pattern generating process (S130) according to the first embodiment.
Figure 4:
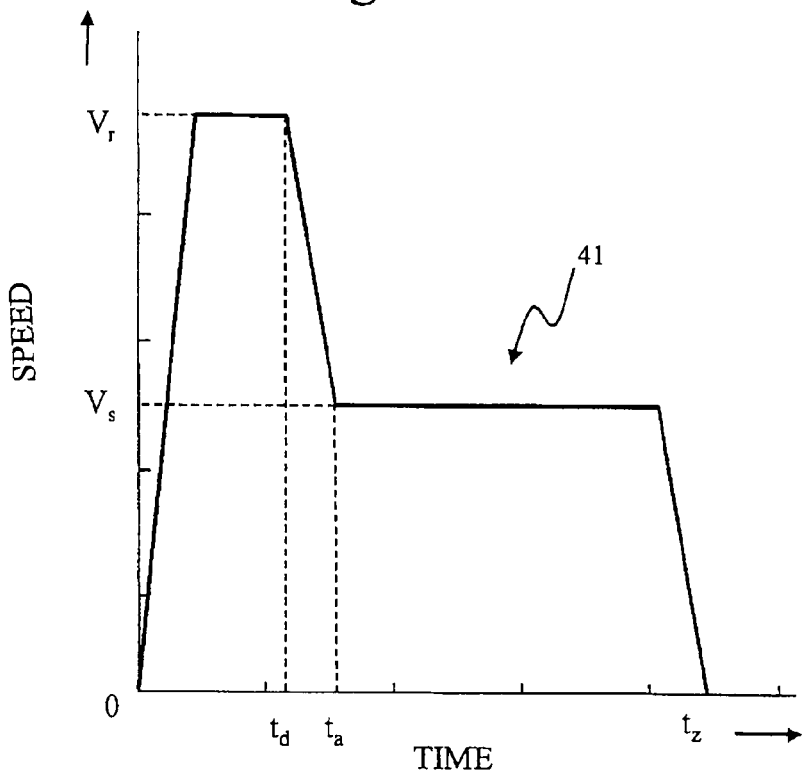
FIG. 4 shows a graph of a speed pattern 41 of the partially low speed operation according to the first embodiment.
Figure 5:
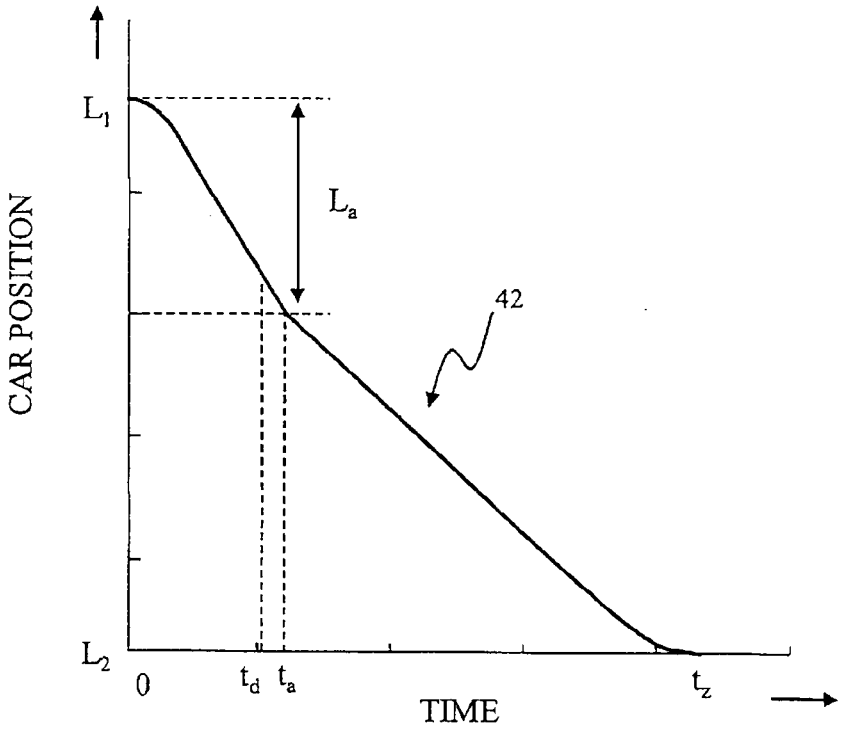
FIG. 5 shows a graph of a travel pattern 42 of the partially low speed operation according to the first embodiment.
Figure 6:
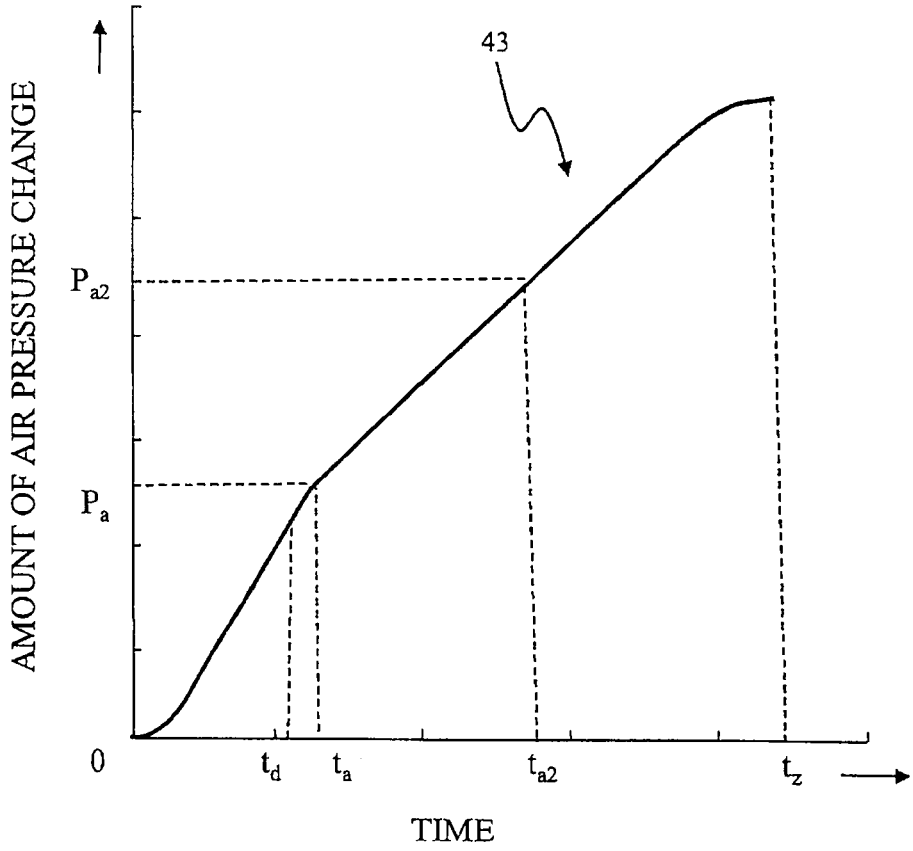
FIG. 6 shows a graph of an air pressure pattern 43 of the partially low speed operation according to the first embodiment.
Figure 7:
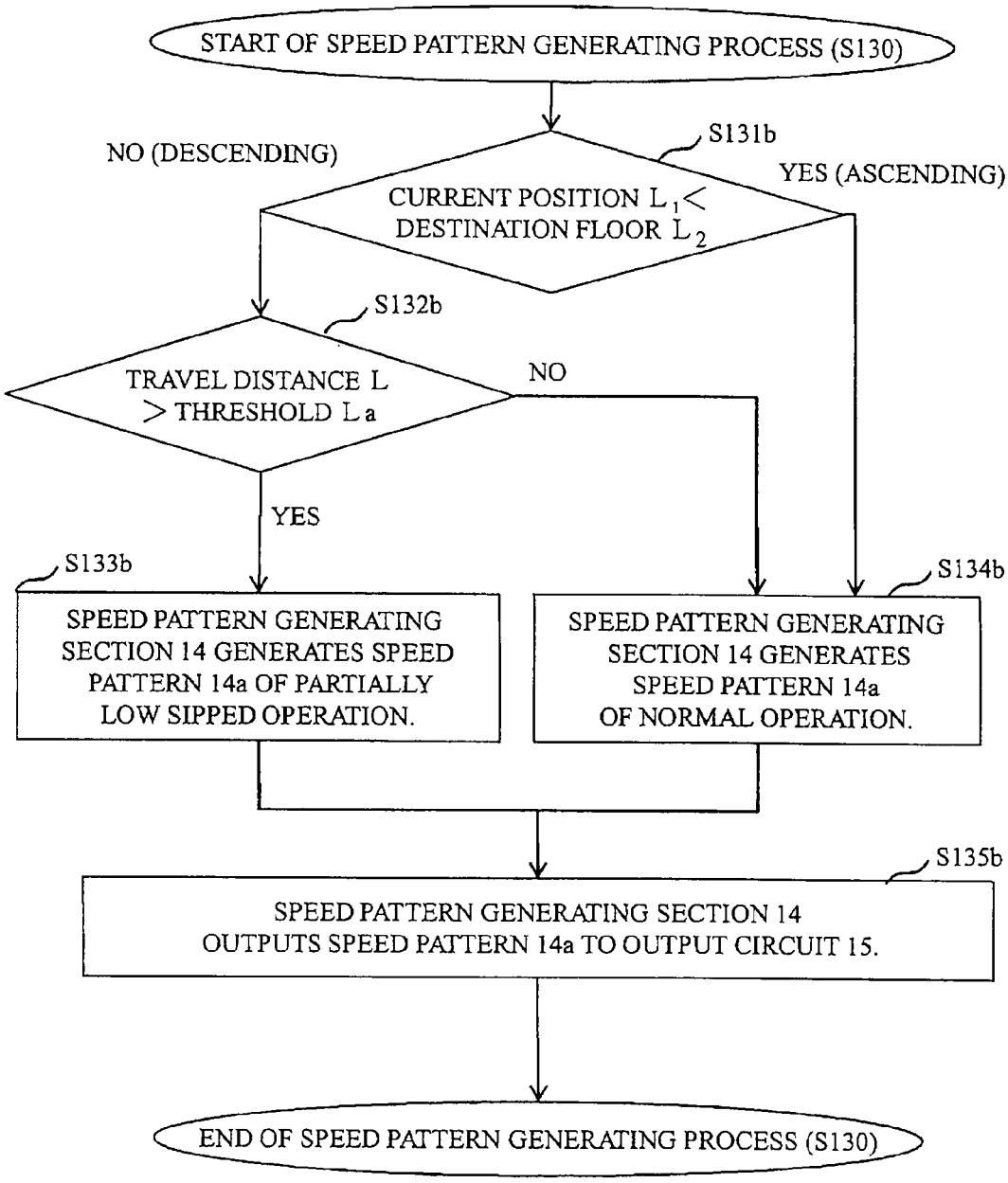
FIG. 7 shows a flow chart of the speed pattern generating process (S130) according to a second embodiment.
Figure 8:
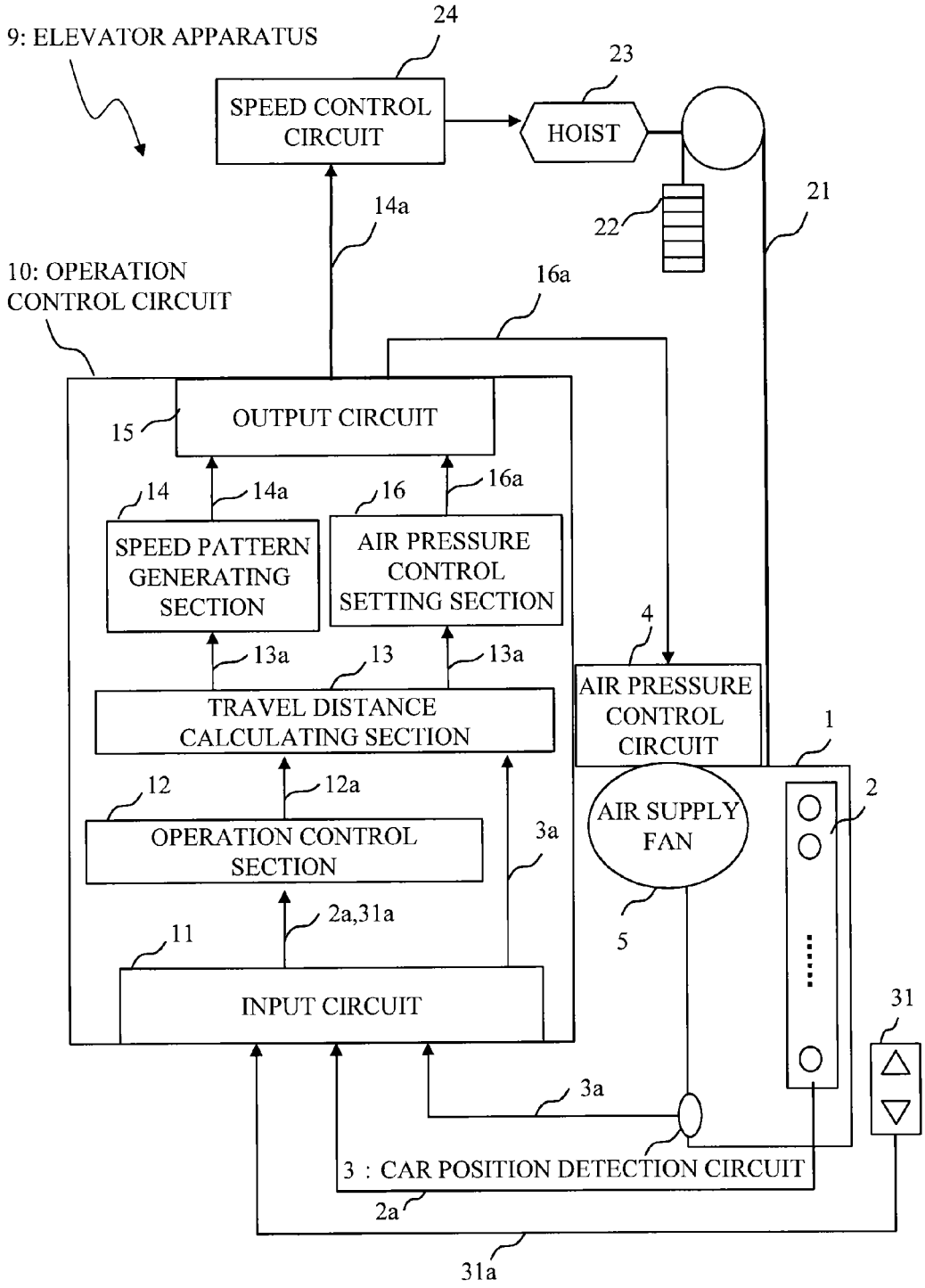
FIG. 8 shows a configuration of the elevator apparatus 9 according to a third embodiment.
Figure 9:
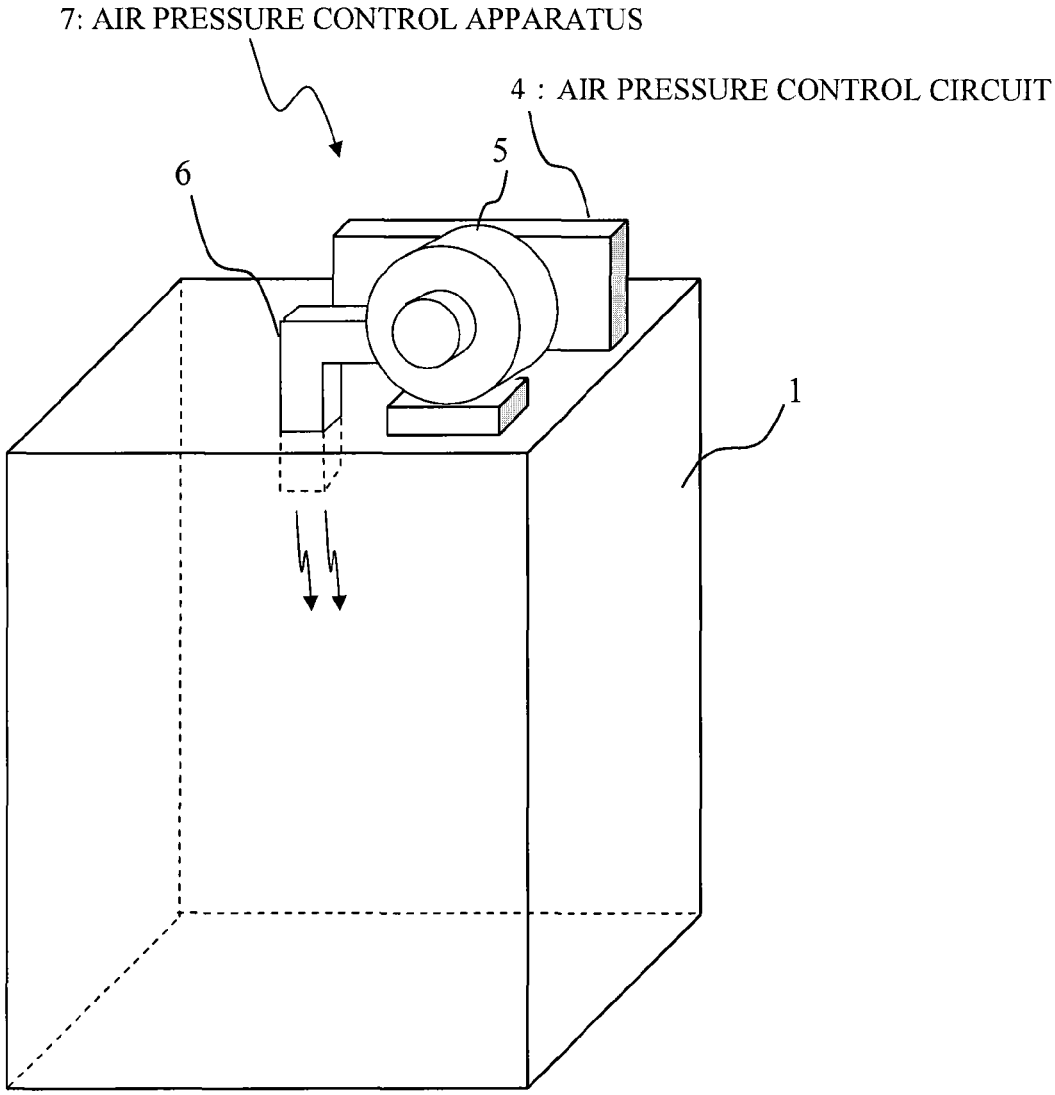
FIG. 9 shows a configuration of a car room 1 according to the third embodiment.
Figure 10:
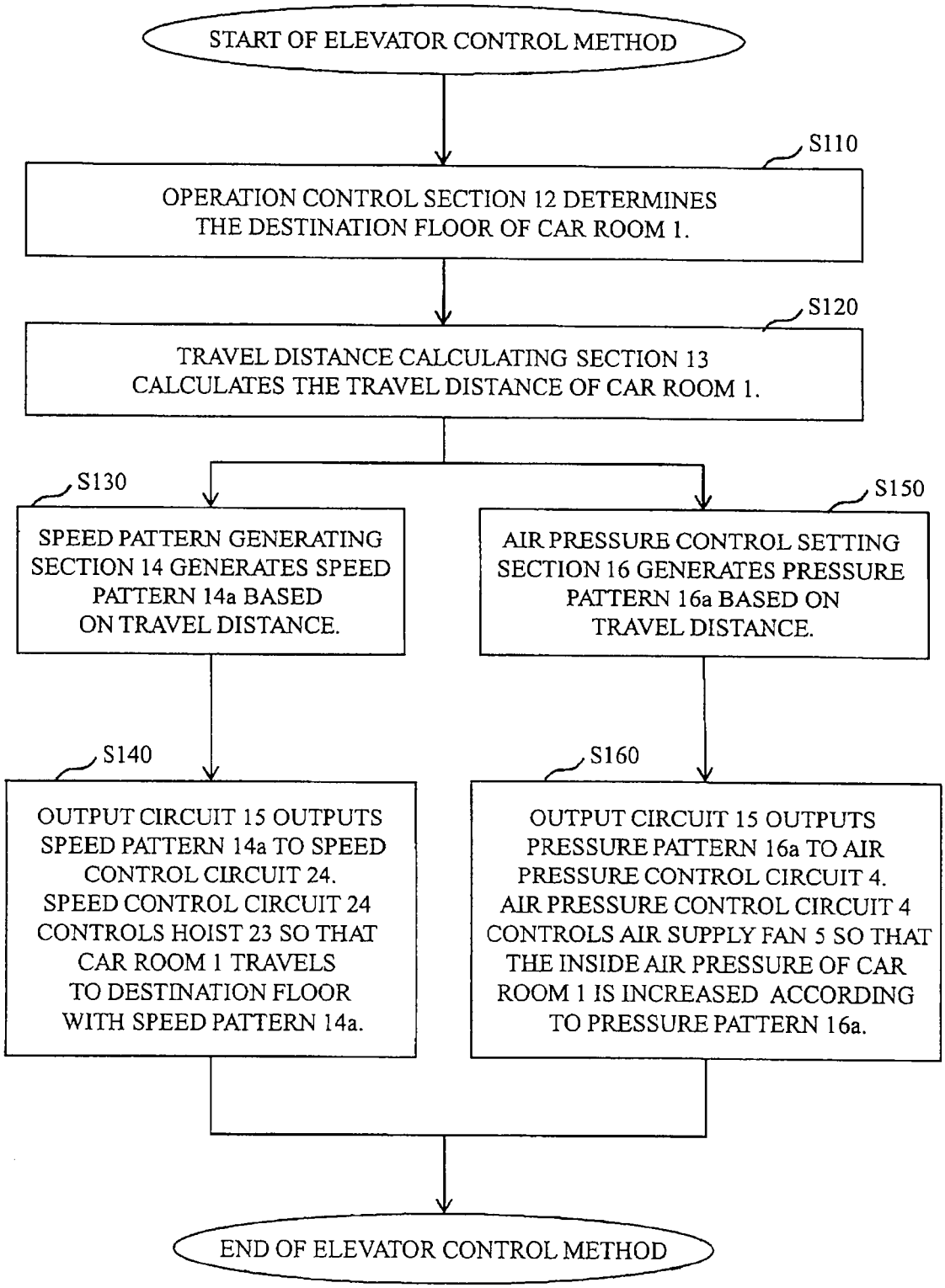
FIG. 10 shows a flow chart of an elevator control method according to the third embodiment.
Figure 11:
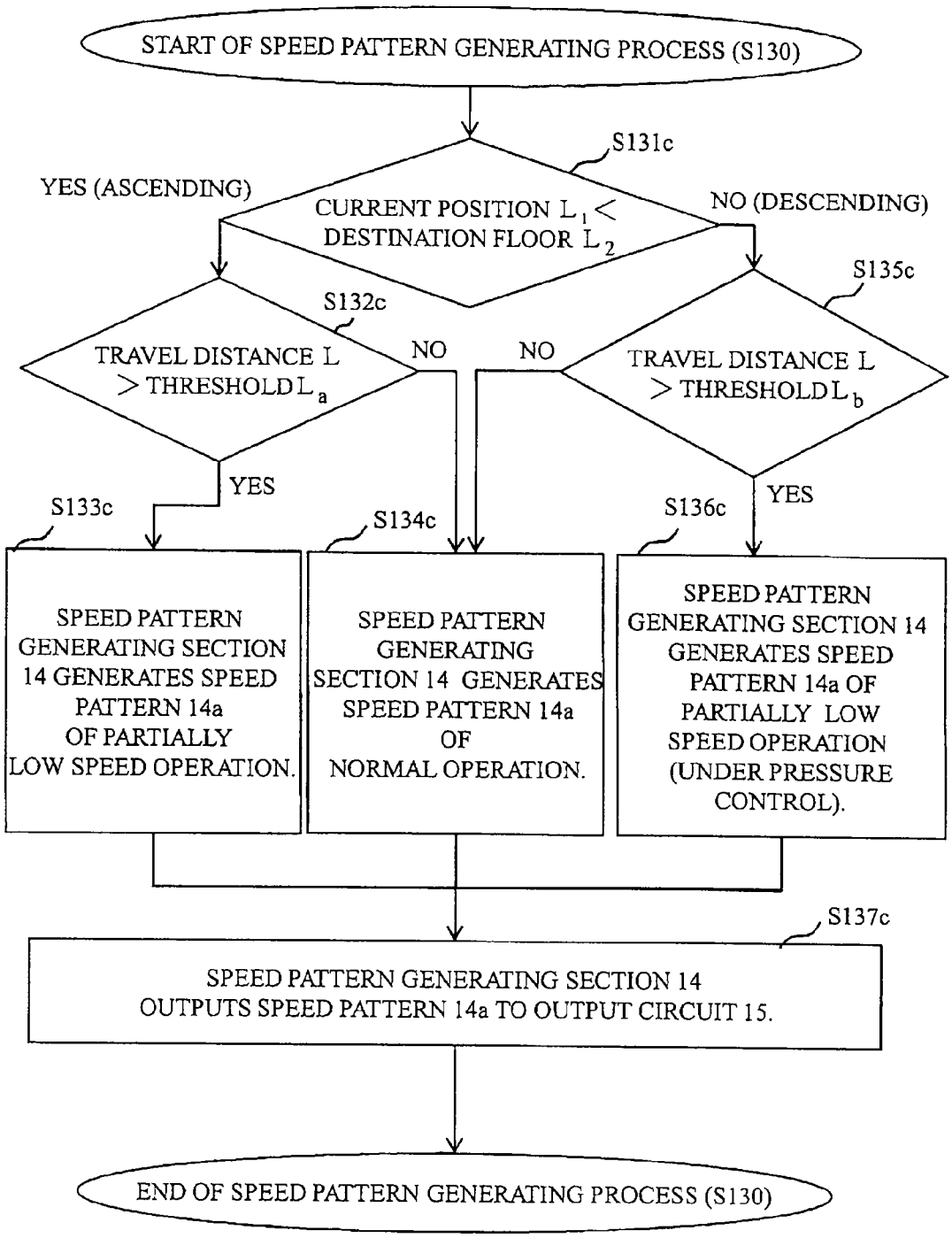
FIG. 11 shows a flow chart of the speed pattern generating process (S130) according to the third embodiment.
Figure 12:
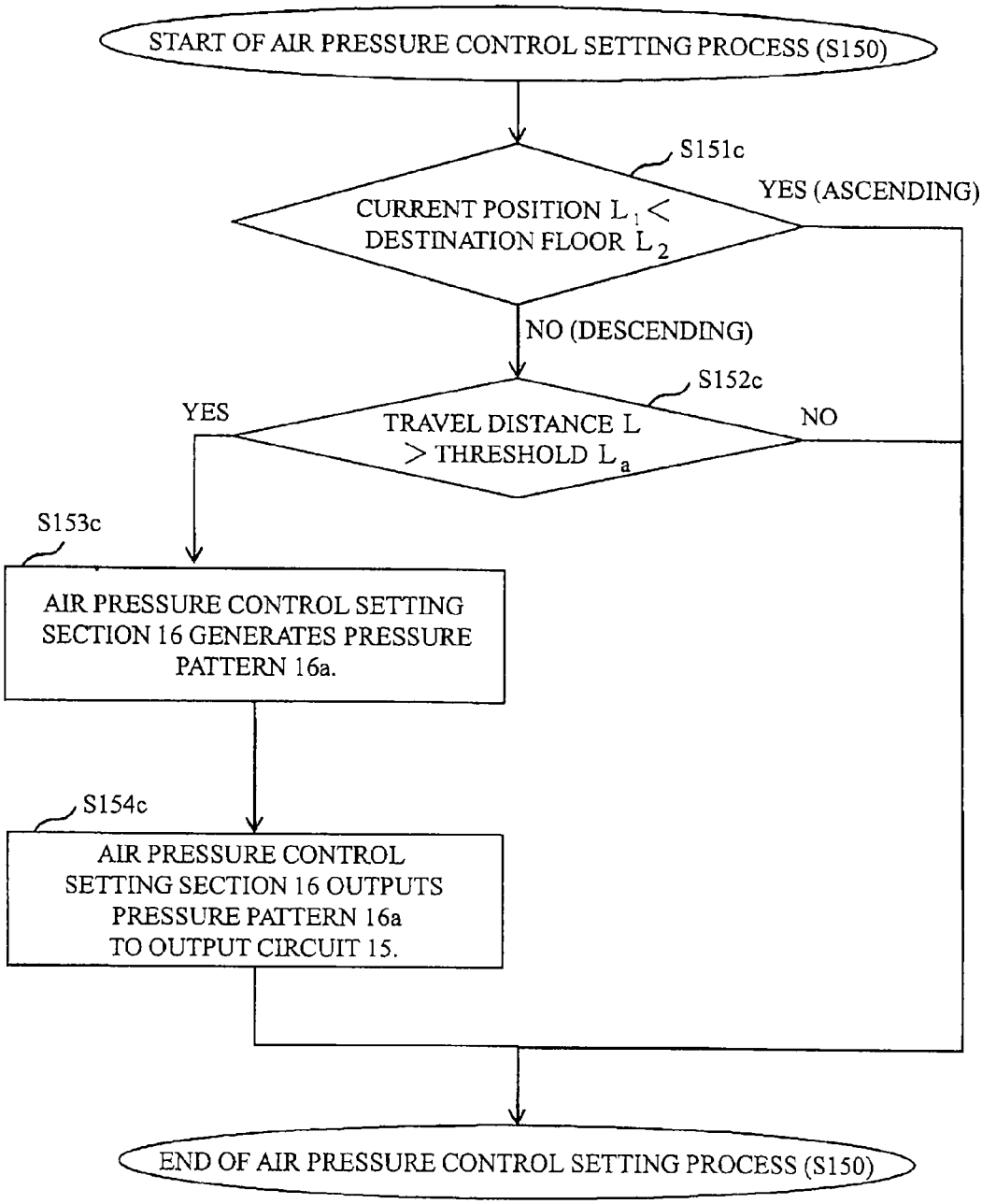
FIG. 12 shows a flow chart of an air pressure control setting process (S150) according to the third embodiment.
Figure 14:
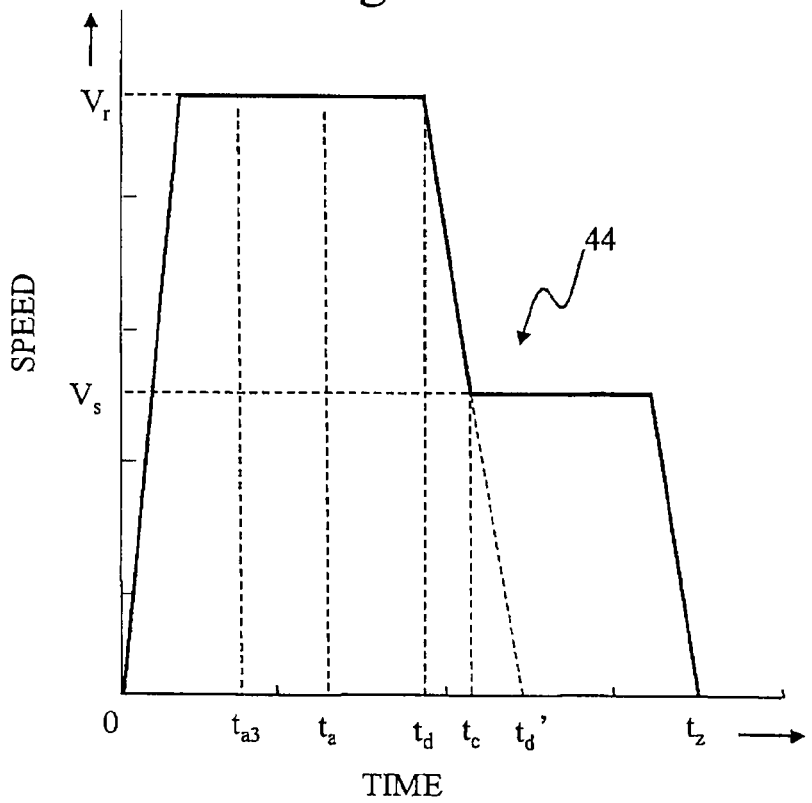
FIG. 14 shows a graph of a speed pattern 44 of the partially low speed operation (under pressure control) according to the third embodiment.
Figure 15:
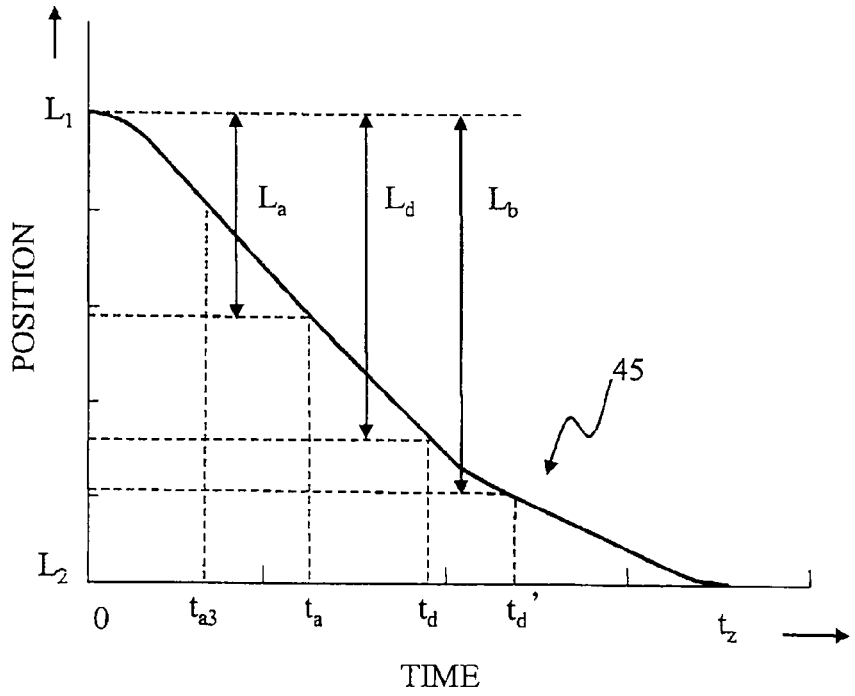
FIG. 15 shows a graph of a travel pattern 45 of the partially low speed operation (under pressure control) according to the third embodiment.
Figure 16:
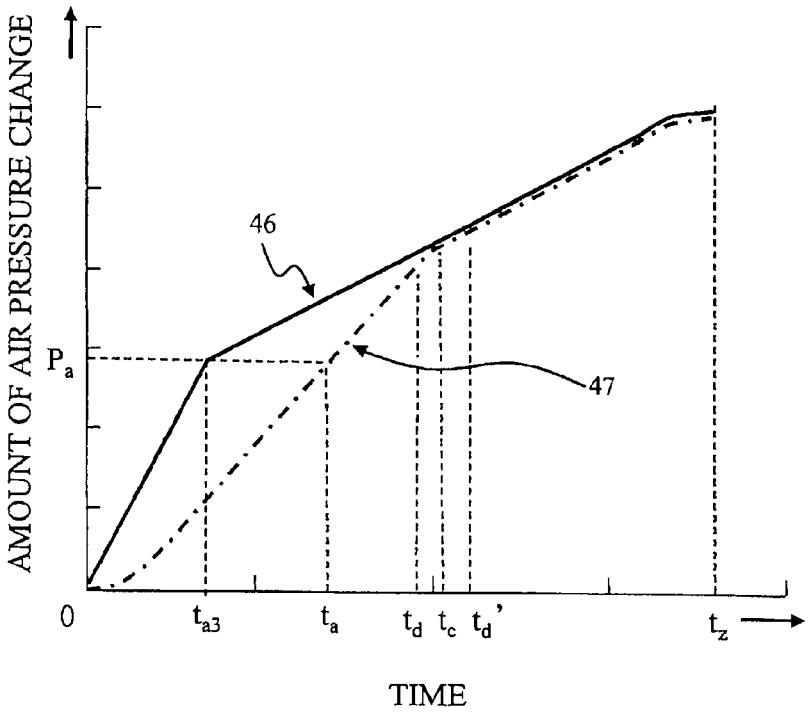
FIG. 16 shows a graph of an air pressure pattern 46 of the partially low speed operation (under pressure control) and an air pressure pattern 47 of the partially low speed operation (without pressure control) according to the third embodiment.
Figure 17:
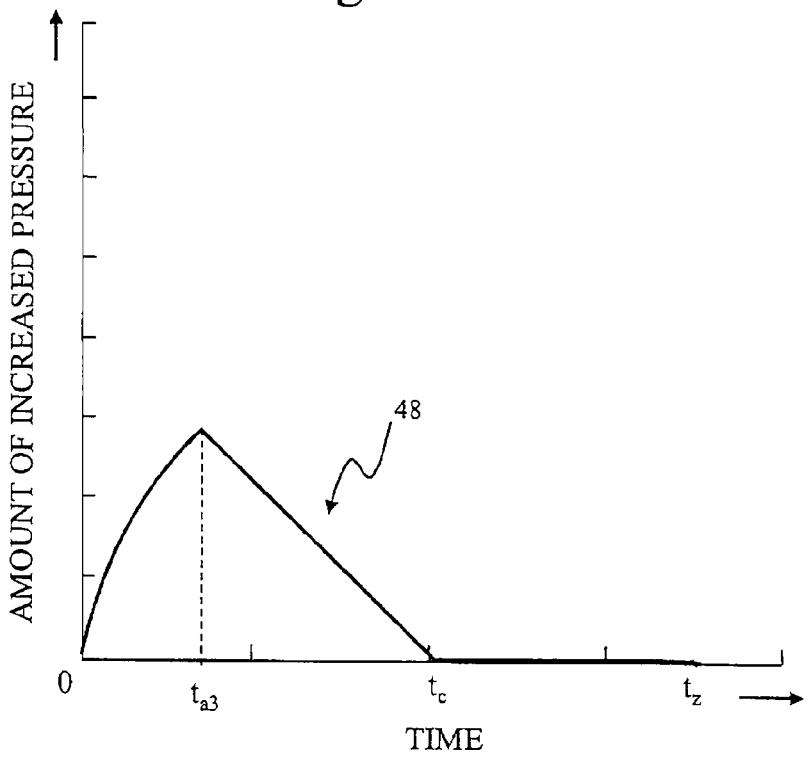
FIG. 17 shows a graph of a pressure pattern 48 according to the third embodiment.
Figure 18:
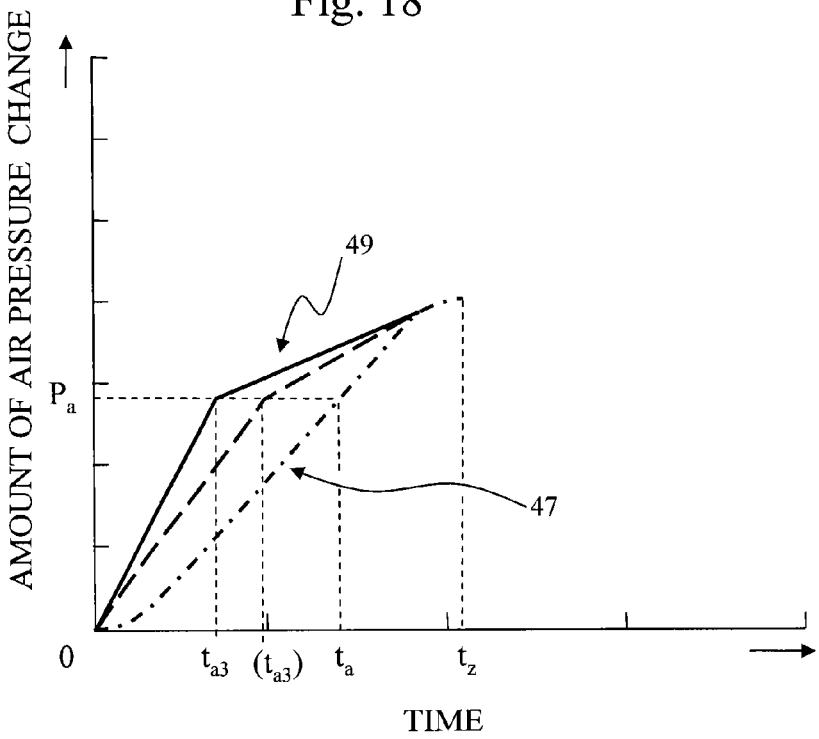
FIG. 18 shows a graph of an air pressure pattern 49 of the normal operation (under pressure control) according to the third embodiment.
Figure 19:
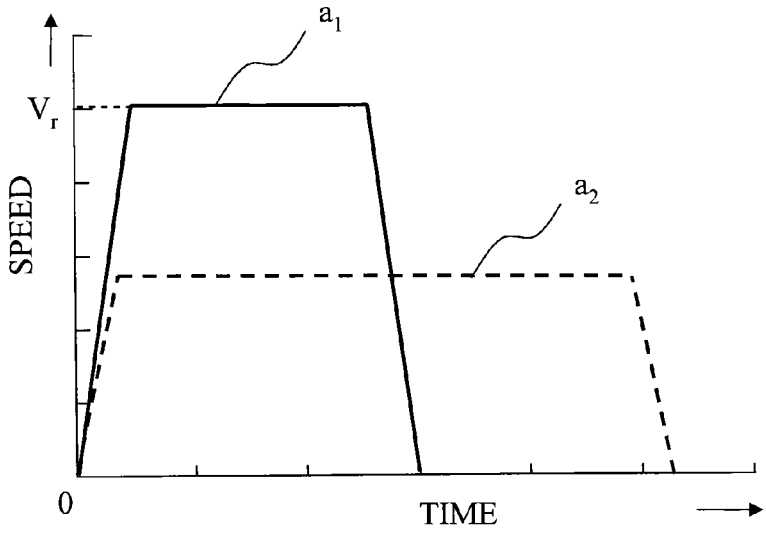
Fig. 19 RELATED ART
FIG. 19 shows a pattern of a speed control of an existing elevator.
Figure 20:
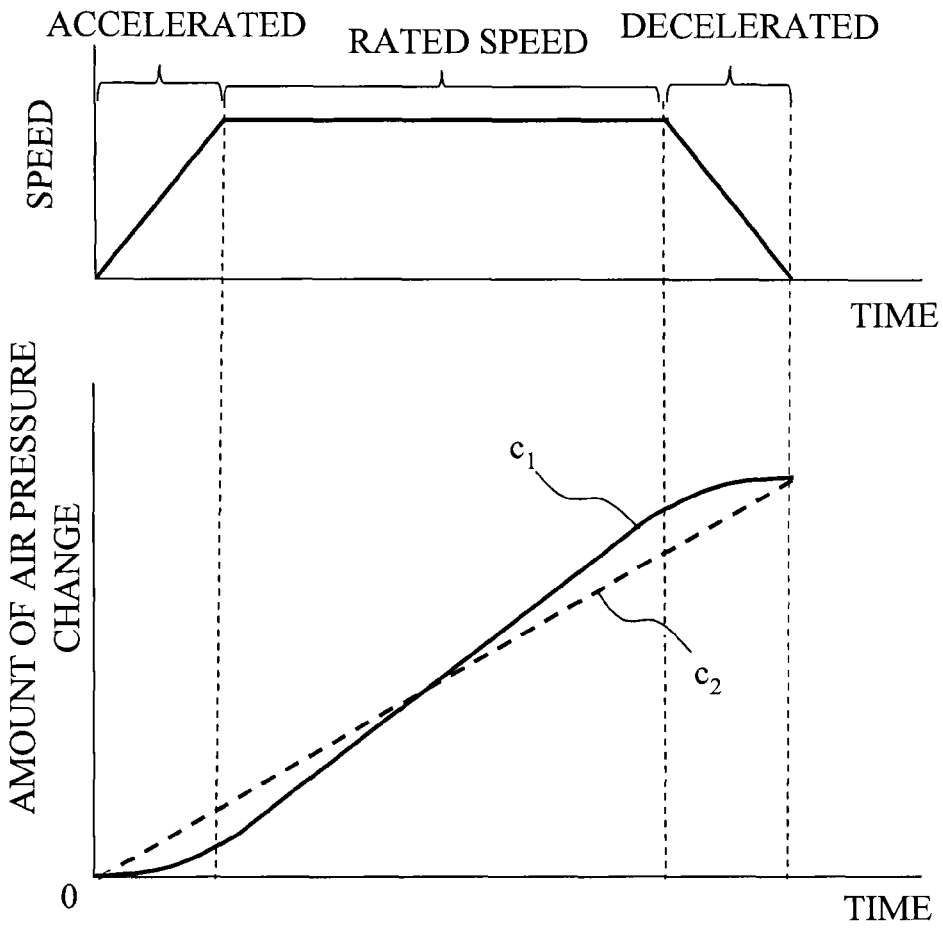
Fig. 20 RELATED ART
FIG. 20 shows a pattern of an air pressure control of an existing elevator.

1 car room
2 in-car control panel
2*a* in-car call command signal
3 car position detection circuit
3*a* car position command signal
4 air pressure control circuit
5 air supply fan
6 air supply duct
7 air pressure control apparatus
9 elevator apparatus
10 operation control circuit
11 input circuit
12 operation control section
12*a* destination floor information
13 travel distance calculating section
13*a* travel distance information
14 speed pattern generating section
14*a* speed pattern
15 output circuit
16 air pressure control setting section
16*a* pressure pattern
21 rope
22 counterweight
23 hoist
24 speed control circuit
31 floor control panel
31*a* floor call command signal
41 speed pattern of the partially low speed operation
42 travel pattern of the partially low speed operation
43 air pressure pattern of a partially low speed operation
44 speed pattern of the partially low speed operation (under pressure control)
45 travel pattern of the partially low speed operation (under pressure control)
46 air pressure pattern of the partially low speed operation (under pressure control)

47 air pressure pattern of the partially low speed operation (without pressure control)
48 pressure pattern
49 air pressure pattern of the normal operation (under pressure control)
$V_r$ rated speed
$V_s$ low speed
$t_a$ $L_a$ reaching time
$t_{a3}$ $P_a$ change time
$t_c$ pressure control ending time
$t_d'$ deceleration extending time
$t_d$ deceleration starting time
$t_z$ destination floor reaching time
$P_a$ first air pressure opening the Eustachian tube
L travel distance
$L_a$ first height difference opening the Eustachian tube
$L_b$ height differential threshold under pressure control
$L_d$ reaching distance under deceleration

The invention claimed is:

1. An elevator control apparatus comprising:

a travel distance calculating section configured to calculate a travel distance of an elevator car to a destination floor of the elevator car;

a speed pattern generating section configured to compare the travel distance calculated by the travel distance calculating section with a predetermined distance; generate a speed pattern that is control information indicating a normal operation if the travel distance is the same or less than the predetermined distance, wherein the normal operation makes the elevator car accelerate up to a rated speed, move at the rated speed, and decelerate until the elevator car stops; and generate a speed pattern that is control information indicating a partially low speed operation if the travel distance is larger than the predetermined distance, wherein the partially low speed operation makes the elevator car accelerate up to the rated speed, move at the rated speed, decelerate to a predetermined low speed, which is lower than the rated speed, move at the predetermined low speed, and decelerate until the elevator car stops; and a speed control section configured to make the elevator car move to the destination floor based on the speed pattern generated by the speed pattern generating section.

2. The elevator control apparatus according to claim 1 further comprising an air pressure control setting section configured to compare the travel distance with the predetermined distance when the elevator car is descended to the destination floor, and increase air pressure in the elevator car up to a predetermined air pressure by supplying air into the elevator car if the travel distance is larger than the predetermined distance.

3. The elevator control apparatus according to claim 2, wherein the speed pattern generating section compares the travel distance with a second predetermined distance that is longer than the predetermined distance when the elevator car is descended to the destination floor; generates the speed pattern that is the control information indicating the normal operation if the travel distance is the same or less than the second predetermined distance; and generates the speed pattern that is the control information indicating the partially low speed operation if the travel distance is larger than the second predetermined distance.

4. The elevator control apparatus according to claim 1, wherein the predetermined distance indicates a difference in height corresponding to a difference in air pressure causing the Eustachian tube of a passenger in the elevator car to open.

5. The elevator control apparatus according to claim 1, wherein the speed pattern that is the control information indicating the partially low speed operation specifies that a running speed of the elevator car reach the predetermined low speed when the elevator car decelerates from the rated speed and runs for the predetermined distance.

6. The elevator control apparatus according to claim 1, wherein the speed pattern generating section generates the speed pattern that is the control information indicating the partially low speed operation if the elevator car is descended to the destination floor, and if the travel distance is larger than the predetermined distance.

7. The elevator control apparatus according to claim 2, wherein the predetermined air pressure indicates a difference in air pressure causing the Eustachian tube of a passenger in the elevator car to open.

8. The elevator control apparatus according to claim 2, wherein the air pressure control setting section increases the air pressure in the elevator car up to the predetermined air pressure, and further increases the air pressure in the elevator car by an amount of increased pressure that makes an amount of raised pressure per unit time based on a sum of an amount of raised pressure in the elevator car under air pressure control and an amount of raised pressure in the elevator car according to a descending of the elevator car equal to an amount of raised pressure per unit time of the air pressure in the elevator car when the elevator car is descended at the predetermined low speed.

9. The elevator control apparatus according to claim 3, wherein the speed pattern that is the control information indicating the partially low speed operation specifies that the elevator car reach the predetermined low speed if the air pressure in the elevator car becomes equal to air pressure outside the elevator car.

10. An elevator apparatus comprising the elevator control apparatus according to claim 1.

* * * * *